US007646678B2

(12) United States Patent
Imai et al.

(10) Patent No.: US 7,646,678 B2
(45) Date of Patent: Jan. 12, 2010

(54) ANALOG WATCH

(75) Inventors: Toshiyuki Imai, Aichi (JP); Hiroyuki Satou, Aichi (JP); Masahide Hasegawa, Aichi (JP); Kazuhisa Tohyama, Aichi (JP); Keiji Nakagawa, Aichi (JP); Kentarou Hayashi, Aichi (JP)

(73) Assignee: Ricoh Elemex Corporation, Aichi (JP)

( * ) Notice: Subject to any disclaimer, the term of this patent is extended or adjusted under 35 U.S.C. 154(b) by 27 days.

(21) Appl. No.: 11/663,503

(22) PCT Filed: Sep. 20, 2005

(86) PCT No.: PCT/JP2005/017270

§ 371 (c)(1),
(2), (4) Date: Mar. 22, 2007

(87) PCT Pub. No.: WO2006/033317

PCT Pub. Date: Mar. 30, 2006

(65) Prior Publication Data

US 2008/0101161 A1 May 1, 2008

(30) Foreign Application Priority Data

| | | |
|---|---|---|
| Sep. 24, 2004 | (JP) | 2004-276516 |
| Mar. 24, 2005 | (JP) | 2005-085223 |
| Mar. 25, 2005 | (JP) | 2005-088145 |
| Mar. 28, 2005 | (JP) | 2005-091138 |
| Mar. 29, 2005 | (JP) | 2005-093821 |
| Jul. 13, 2005 | (JP) | 2005-203875 |

(51) Int. Cl.
*G04C 17/00* (2006.01)

(52) U.S. Cl. ..... 368/83; 368/71; 368/241

(58) Field of Classification Search ..... 368/71, 368/241, 83, 88
See application file for complete search history.

(56) References Cited

U.S. PATENT DOCUMENTS 3,817,021 A * 6/1974 Bergey ..... 368/69

(Continued)

FOREIGN PATENT DOCUMENTS

JP 54-46284 3/1979

(Continued)

OTHER PUBLICATIONS

Notification Of Transmittal of Translation Of The International Preliminary Report On Patentability (Chapter I or Chapter II Of The Patent Cooperation Treaty) (Form PCT/IB/338).

(Continued)

*Primary Examiner*—Vit W Miska
*Assistant Examiner*—Sean Kayes
(74) *Attorney, Agent, or Firm*—Smith, Gambrell & Russell, LLP

(57) ABSTRACT

Provided is a watch capable of performing digital display as well as analog display. The watch can offer digital display without posing disadvantages peculiar to a liquid crystal panel. On the other hand, the watch can reduce the restrictions in design and make the digital display larger and easier to see. The watch includes a light-shielding plate 22 on the rear side of the dial 24. In the light-shielding plate, light-transmitting holes 23 are made piercing from a front of the light-shielding plate to a rear thereof. Thin chip LEDs 17 are inserted in the light-transmitting holes, and mounted on a circuit board 16. The circuit board is placed on the rear side of the light-shielding plate. On the rear side of the circuit board, an analog movement 13 is provided, and an LED drive circuit 33 for driving the LEDs is placed. Thus, the LEDs 17 for digital display are placed on the rear side of the dial. The dial is formed so as to have an optical transmittance such that the digital display with the LEDs can be visually identified through the dial only when the LEDs are ON.

26 Claims, 26 Drawing Sheets

U.S. PATENT DOCUMENTS

| | | | | |
|---|---|---|---|---|
| 4,533,256 | A * | 8/1985 | Ostendorf | 368/111 |
| D435,464 | S * | 12/2000 | Bland et al. | D10/39 |
| 6,466,522 | B1 * | 10/2002 | Yoshioka et al. | 368/223 |
| 2003/0146736 | A1 | 8/2003 | Kosuda et al. | |
| 2004/0124430 | A1 | 7/2004 | Yano et al. | |
| 2005/0243653 | A1 * | 11/2005 | Lizzi | 368/71 |

FOREIGN PATENT DOCUMENTS

| | | |
|---|---|---|
| JP | 54-172766 | 12/1979 |
| JP | 56-92488 | 7/1981 |
| JP | 57-40676 | 3/1982 |
| JP | 58-88688 | 5/1983 |
| JP | 62-124589 | 8/1987 |
| JP | 2-147015 | 6/1990 |
| JP | 5-45521 | 6/1993 |
| JP | 5-52786 | 7/1993 |
| JP | 6-347573 | 12/1994 |
| JP | 8-122468 | 5/1996 |
| JP | 8-227280 | 9/1996 |
| JP | 11-304967 | 11/1999 |
| JP | 2002-171678 | 6/2002 |
| JP | 2003-22052 | 1/2003 |
| JP | 2004-4217 | 1/2004 |
| JP | 2004-53342 | 2/2004 |
| JP | 2004-193580 | 7/2004 |
| JP | 2004-253404 | 9/2004 |

OTHER PUBLICATIONS

International Preliminary Report On Patentability (Form PCT/IB/373).

Written Opinion Of The International Searching Authority (Form PCT/ISA/237).

* cited by examiner (A)

(B)

(A)

(B)

(A)

(B)

(A)

(B)

(A)

(B)

(A)

(B)

(A)

(B)

(A)

(B)

(C)

ANALOG WATCH

TECHNICAL FIELD

The present invention relates to an analog watch which can display the time in analog with hands, and the time, month and date, day of the week, etc. in digital with light-emitting diodes (LEDs) as required.

BACKGROUND ART

Conventionally, a watch that performs both analog display and digital display has incorporated a liquid crystal panel for digital display, whose power consumption is smaller. With such watch, a liquid crystal panel is placed in a location in a dial where a digital display window is made, or laid out as a discrete structure by the side of an analog display portion or inside a windshield, for instance.

The examples are described in Japanese Unexamined Patent Publications No. 2004-53342 and No. 8-122468, and Japanese Unexamined Utility Model Publication No. 54-172766.

DISCLOSURE OF THE INVENTION

Problems that the Invention is to Solve

However, a liquid crystal panel has had the disadvantages of the restriction in color, and the unattractiveness of its appearance and the ungracefulness thereof because of its display color of black. Also, a liquid crystal panel has had the specific disadvantage of the difficulty in seeing the display in a poorly lit place e.g. in the night. On this account, a liquid crystal panel has required a light source for illumination, and therefore measures including use of an EL as a liquid crystal panel backlight and use of LEDs for lighting the liquid crystal panel sidewise have been taken. Meanwhile, in order to perform digital display in addition to analog display, a measure such as making a display window in a dial must be taken, as stated above, which has posed the problems including the restriction in design, and the difficulty in seeing the display owing to its reduced display size. For example, as described in the Japanese Patent Publication No. 8-122468, there has been a watch of a type such that digital display is performed by LEDs. However, such watch has been able to perform smaller display because its analog movement is placed by the side of the LEDs in the same plane as that where the LEDs lie.

Therefore, it is the first object of the invention, in association with a watch capable of performing digital display as well as analog display, to achieve a digital display which does not pose the disadvantages peculiar to a liquid crystal panel including the unattractiveness of its appearance and the ungracefulness thereof and the difficulty in seeing the display in a poorly lit place on one hand, and which reduces the restriction in design and makes larger and easier the digital display on the other hand.

It is the second object of the invention to define the outline of a displayed character distinctly thereby to perform digital display sharply and clearly.

It is the third object of the invention to perform overall digital display uniformly and clearly without causing partial non-uniformity in contrast.

It is the fourth object of the invention to assemble the components compactly thereby to miniaturize the entire watch.

It is the fifth object of the invention to achieve analog and digital displays larger and easier to see.

Also, as stated in the Japanese Unexamined Utility Model Publication No. 54-172766, for example, an arrangement using a dot LED needs a large number of the LEDs to display a numeral, which poses not only the problem of making a drive circuit more complicated but also the problem of increasing the cost.

Therefore, it is the sixth object of the invention to reduce the cost by reducing the number of the LEDs and simplifying the drive circuit.

Meanwhile, the cost reduction by decrease in the number of the LEDs and simplification of the configuration of the drive circuit has posed a problem such that display by the LEDs cannot spread to the dial sufficiently and thus clear digital display cannot be achieved.

Hence, it is seventh object of the invention to enable clear digital display.

Meanwhile, in the past there have been, as a watch with a light source for illumination have been, one which has an LED positioned in a parting portion for illuminating a dial sidewise, one which uses a light-guide plate to guide light from an LED to the backside of a dial and radiate the light as backlight, one which uses an EL as backlight, etc. However, any of them have presented the problems of the upsizing and the unattractiveness of its appearance.

Therefore, it is the eighth object of the invention, in association with a watch capable of performing digital display as well as analog display, to make available an illumination device for illuminating surroundings of a watch without upsizing and making the appearance unattractive.

It is the ninth object of the invention, in association with a watch capable of performing digital display as well as analog display, to extend the functionality thereby to increase its added value further.

Now, a watch with an illuminating function using a primary battery as its power source has been restricted in battery capacity because of its small primary battery size. On this account, when the light source for illumination is used multiple times, the battery capacity is emptied quickly and thus the battery has to be replaced with a new one. However, many watches have a water-proof function, and are difficult for a user to replace the battery on his/her own. Therefore, such watches require that their batteries should be replaced in a specialty store or shop, which has been extremely troublesome. In addition, it has not been allowed to increase the brightness of an LED or to elongate a lighting time of illumination because such action hastens the battery drain.

Therefore, it is the tenth object of the invention to allow a user to use the illuminating function to his/her heart's content without paying attention to the life time of a battery and bothering about the inconveniences of replacing the battery and the cost therefor.

Meanwhile, a watch incorporating a solar battery has been restricted in the shape and design of its dial because the dial is configured with a solar battery, for example. In regard to watches like that, it has been impossible to achieve a sufficient charged amount depending on their usage conditions including the use out of doors and in winter. In contrast, a watch of a type that is charged electrically through direct connection with a terminal needs to be structured so that the terminal can be attached to a watch case. This leads to a unique form of the watch case, posing problems including an increase in complexity of its water-proof function.

Accordingly, it is the eleventh object of the invention to enable such watch to be charged readily and reliably without being restricted in design and making the watertight structure more complicated.

Meanwhile, conventionally a watch which performs digital display as well as analog display converts an oscillation frequency at an output terminal of an internal oscillation circuit thereof into a motor-driving pulse signal through an oscillation circuit, a divider circuit and a converter circuit inside an IC of an analog timepiece and drives a stepping motor, thereby to move hands to display the time in analog on the one hand, and derives a count output from an oscillation frequency at the output terminal of the internal oscillation circuit with a divider circuit and a converter circuit inside an IC of an LED timepiece, and enters the output into an LED display through a decoder thereby to display the time on the LED display in digital on the other, as described in e.g. Japanese Patent publication No. 8-122468. However, an analog display and a digital display thereof are driven with different pulse timings respectively, which causes a time difference between them and makes the looks worse.

Therefore, it is the twelfth object of the invention, in association with a watch which performs digital display as well as analog display, to eliminate the time difference between analog and digital displays thereby to increase the commercial value.

Conventionally, a digital watch has had four digits of numeral displays DIG1, DIG2, DIG3 and DIG4 formed on a display face 1 by light sources such as LEDs, which are in pairs assigned and arrayed in a line on right and left sides of a colon 2 and display the time in digital as a whole as shown in FIG. 24, for example. In addition, as shown in FIG. 25, the numeral displays DIG1, DIG2, DIG3 and DIG4 are each made to stay on for a time "b" at constant intervals "a" intermittently. Moreover, the numeral displays DIG1, DIG2, DIG3 and DIG4 are shifted by a time "c," switched and turned on in turn, and perform display for a time "d" totally.

However, conventionally the light source-lighting interval "a," light source-lighting time "b" and light source break time "c" have been all fixed, whereas the duty ratio, which is a ratio of the lighting time "b" of each light source with respect to the total display time "d" for digital display, has been fixed. In addition, the duty ratio has been set to be larger in order to lighten the display as much as possible. If a light source is used for backlight of a liquid crystal, surrounding illumination for lighting the surrounding or for dial lighting for lighting the top of a dial, for example, the brighter, the better. However, in the case where a light source is used for digital display by the numeral displays DIG1, DIG2, DIG3 and DIG4, there has been a problem such that an excessively bright light source makes it difficult to read the digital display.

Therefore, it is the thirteenth object of the invention to achieve an appropriate brightness thereby to facilitate the reading of digital display, in association with a digital timepiece that turns on a light source and displays the time.

Conventionally, a digital watch has been driven by a battery power source. When a battery power source continues passing electric current through a heavy load, its voltage value descends in a discharge curve as shown in FIG. 26 as time goes on. Then, the battery reaches the end of the battery life at the time when the voltage value descends and thus it becomes impossible to gain a voltage value required to operate each element.

As shown in FIG. 26, an operating limit voltage value V1 necessary to operate the control CPU is typically higher than an operating limit voltage value V2 necessary to operate other elements including some passive elements. In other words, although the battery still has a voltage value enough to operate the other parts, it cannot operate the control CPU, reaching the end of the battery life. On this account, measures including: shortening the time during which electric current passes through a load; and cutting down a product life to a shorter one have been taken so far.

However, the measures have brought about various disadvantages. In addition, the voltage of a power source was fluctuated owing to the operation by an LED, etc. and lowered below the operating voltages of a timepiece circuit and an additional function circuit, and thus the watch was not able to operate even though the battery capacity still remained in some cases.

Then, it is the fourteenth object of the invention to elongate a battery life, in association with a watch having an electric circuit including: a battery; a control CPU that accepts supply of electric power from the battery, and a controlled part that is made to work by the control CPU.

Means for Solving the Problems

To achieve the first object, an analog watch is characterized by including: a dial; and LEDs for digital display placed on a rear side of the dial, wherein the dial is formed so as to have an optical transmittance that allows digital display by the LEDs to be visually identified through the dial only when the LEDs are turned ON.

In the watch which performs digital display as well as analog display, the LEDs are not turned on normally, and hands are used to display the time in analog. The LEDs are turned on as required, for example, in the case where it is desired to check the time, etc. in a poorly lit place. Then, the time, month and date, day of the week, etc. are displayed through the dial digitally.

It is preferable that the dial be formed by e.g. applying a coat to a transparent material or using a colored semitransparent material instead, and its optical transmittance is made 1-70%.

To achieve the second object, it is preferable that the analog watch include a light-shielding plate on the rear side of the dial and light-transmitting holes made in the light-shielding plate so as to piercing from a front of the light-shielding plate to a rear thereof, wherein lights from the LEDs travel through the light-transmitting holes and impinge on the dial, for example.

Here, to achieve the third object, the light-shielding plate is formed by using a plate-like resin member with a high light-shielding ability and applying a light-diffusing coat to inner faces of the light-transmitting holes of the resin member, or otherwise by using a plate-like resin member having a high photoreflectance and applying a light-shielding coat to a plate surface of the resin member.

To achieve the fourth object, it is preferable that the analog watch include a circuit board placed on a rear side of the light-shielding plate, on which the LEDs are mounted at locations corresponding to the light-transmitting holes; an analog movement provided on a rear side of the circuit board; a hand-moving shaft piercing from the circuit board through the light-shielding plate to the dial, the hand-moving shaft having a leading end exposed on a front side of the dial; and an LED drive circuit for driving the LEDs, placed on the rear side of the circuit board.

In this case, to achieve the fifth object, it is preferable that the analog watch include: a pair of the LEDs provided so as to sandwich a central hole of the circuit board through which the hand-moving shaft pierces; and a colon composed of the paired LEDs. Further, it is preferable that numeral displays be allocated and placed in pairs so as to sandwich the colon between the pairs.

To achieve the sixth object, it is preferable that the LEDs be provided in one-to-one correspondence with the light-transmitting holes 23. In this case, to achieve the seventh object, it is preferable that a light diffusion treatment be performed on the dial at least in locations corresponding to the light-transmitting holes.

To achieve the eighth object, it is preferable that the LED drive circuit include an LED drive module capable of turning on all the LEDs based on an external operation. Further, to achieve the ninth object, it is preferable that the LED drive circuit include an LED drive module capable of activating an additional clocking function, such as a stopwatch, an alarm or a timer, based on an external operation.

Further, to achieve the tenth object, it is preferable that a secondary battery be used as a power source. In this case, to achieve the eleventh object, it is preferable that the analog watch include a secondary coil which allows the secondary battery to be charged by electromagnetic induction.

To achieve the twelfth object, it is preferable that the analog watch include a control circuit for controlling an analog hands-moving pulse timing and a digital display pulse timing synchronously. Then, in the watch that displays the time both in analog and digital, the control circuit controls the analog hands-moving pulse timing and digital display pulse timing while synchronizing the pulse timings.

For example, in analog time correction, the digital display pulse timing is matched to the analog hands-moving pulse timing synchronously with start of analog hands' moving, and the digital display is subjected to 30-second rounding and then returned back to zero. In digital time correction, the digital display pulse timing is synchronized and matched with the analog hands-moving pulse timing.

To achieve the thirteenth object, it is preferable that the analog watch include a control circuit capable of adjusting a duty ratio. The duty ratio is a ratio of a lighting time during which the LEDs for digital display stay on with respect to a total display time during which digital display is performed. The control circuit changes the duty ratio of each LED for digital display to make the digital display appropriately bright according to various conditions.

The control circuit can change the duty ratio based on time data. When the analog watch includes a photosensor, the control circuit can change the duty ratio based on an output signal from the photosensor. Also, in the case where the analog watch includes a dial for displaying the time in digital, through which light form the LEDs for digital display passes when the LEDs for digital display stay on, the control circuit can change the duty ratio based on the optical transmittance of the dial. Further, the control circuit can change the duty ratio based on the detected voltage data. Still further, when the numeral displays for performing digital display are shifted by a light source break time, switched and turned on in turn, the control circuit can change the duty ratio by altering the light source break time, etc.

To achieve the fourteenth object, it is preferable that the analog watch include: a battery; a control CPU that accepts supply of an electric power from the battery; and a controlled part that accepts supply of the electric power from the battery and is made to work by the control CPU, and the controlled part be provided with a charger pump, and when the control CPU make the controlled part work, an output of the charger pump be fed back to a power source terminal of the control CPU. Then, the charger pump raises the voltage and the output of the charger pump is fed back to the power source terminal of the control CPU when the control CPU makes the controlled part work.

In this case, it is preferable that the analog watch include a means capable of setting the flow of electric current, e.g. a diode, which prevents a flow from the battery and a flow from the charger pump from being mixed. The controlled part may be provided with e.g. a lighting function other than an LED for digital display, a phonetic function for emitting a voice, a motor-driving function for driving a vibrating motor, etc., a sensing function for activating a sensor, a wireless transmitting and receiving function for performing transmission and reception by radio, etc.

ADVANTAGE OF THE INVENTION

According to the invention, as for a watch which performs digital display as well as analog display, the design restriction can be reduced to ensure the variety in design by: arranging LEDs 17 so that they are not turned on normally; using the hands to display the time in analog; hiding the LEDs by the dial out of view; and eliminating the need for making a digital display window in the dial. In addition, the LEDs are turned on, for example, in a poorly lit place as required and then the time, month and date, day of the week, etc. are displayed in digital through the dial and as such, a bright display can be achieved with various colors even in a poorly lit place. As a result, the disadvantages peculiar to a liquid crystal panel, such as the unattractive appearance of the display and the difficulty in seeing the display in a poorly lit place, can be eliminated on one hand; a digital display can be presented widely over the whole dial with an increased visibility on the other hand. Also, it is possible to change a color depending on what is displayed.

As the dial is formed by e.g. applying a coat to a transparent material or using a colored semitransparent material, and has an optical transmittance of 1-70%, the following are made possible: to simply perform analog display without turning on the LEDs normally; and to turn on the LEDs as required to display in digital the time, month and date, day of the week, etc. through the dial reliably.

According to the invention described in claim 4, lights from the LEDs travel through the light-transmitting holes of the light-shielding plate and impinge on the dial. Therefore, the outline of a displayed character can be defined distinctly by the light-transmitting holes, whereby digital display can be performed sharply and clearly.

According to the invention described in claims 5 and 6, the lights passing through the inside of the light-transmitting holes of the light-shielding plate are reflected by the inner faces of the light-transmitting holes. Thus, an entire digital display can be presented uniformly and clearly without partially causing non-uniformity of contrast in the light-transmitting holes 23.

According to the invention described in claim 7, components including the light-shielding plate, circuit board, analog movement, and LED drive circuit can be assembled compactly, and therefore the analog watch can be scaled down generally.

According to the invention described in claim 8, a pair of the LEDs are provided so as to sandwich a central hole of the circuit board through which the hand-moving shaft pierces, and the paired LEDs are used to constitute a colon, whereby the following are made possible: to provide the digital display in a center position of the dial; to present digital display as well as analog display widely over the whole dial; and to present both digital and analog displays larger and easier to see.

According to the invention described in claim 9, as a colon is constituted by a pair of the LEDs arranged so as to sandwich a central hole of the circuit board, and the numeral displays are allocated and placed in pairs so as to sandwich the colon. Therefore, a circuit board having nearly the same size as that of the dial can be used, and when the numeral displays are laid out over the whole circuit board, the entire plate surface of the dial can be used effectively thereby to make digital display larger and easier to see.

According to the invention described in claim 10, the LEDs are provided in one-to-one correspondence with the light-transmitting holes. Therefore, the number of the LEDs can be reduced and the configuration of the drive circuit can be simplified, whereby the cost can be reduced.

According to the invention described in claim 11, a light diffusion treatment is performed on the dial at least in locations corresponding to the light-transmitting holes. Hence, even when the number of the LEDs is reduced, the portions subjected to the light diffusion treatment diffuse lights from the LEDs and allow the lights to pass through the light-transmitting holes uniformly. Therefore, clear digital display can be performed.

According to the invention described in claim 12, as the LED drive circuit includes an LED drive module capable of turning on all the LEDs based on an external operation, the LED drive circuit can be made to activate by an external operation to turn on all the LEDs in a place where lighting is required. Therefore, the analog watch can be also utilized as an illumination device for lighting surroundings of the watch without the need for an additional light source for illumination. As the LEDs for displaying the time, etc. can be utilized for lighting as they are, the watch is not upsized, nor worsened in its appearance.

According to the invention described in claim 13, as the LED drive circuit includes an LED drive module capable of activating an additional clocking function, such as a stopwatch, an alarm or a timer based on an external operation. Therefore, a watch which performs digital display as well as analog display can be extended in functionality, thereby to increase the added value thereof.

According to the invention described in claim 14, as a secondary battery is used as a power source, even when frequent use of the LEDs has exhausted the battery, only charging the battery suffices instead of replacing the battery. Therefore, the illuminating function can be used fully without the need for paying attention to the battery life and bothering about the inconvenience for battery replacement and the cost therefor. As a result, it becomes possible to obviate the disadvantage posed by digital display performed with the LEDs that consume a larger amount of electric power in comparison to liquid crystal panels.

According to the invention described in claim 15, the analog watch includes a secondary coil which allows the secondary battery to be charged by electromagnetic induction. Therefore, it becomes possible to achieve simple and reliable charging without being restricted in design and making the watertight structure more complicated.

According to the invention described in claims 16 to 19, in the watch that displays the time both in analog and digital, the control circuit controls an analog hands-moving pulse timing and a digital display pulse timing synchronously. Thus, the time difference between the analog display and digital display is obliterated thereby to increase the commercial value. When the digital display is made to return back to zero according to the 30-second rounding efforts to correct the time in seconds can be eliminated.

According to the invention described in claims 20 to 25, in the digital timepiece that turns on LEDs for digital display and displays the time in digital, the control circuit changes the duty ratio of LEDs for digital display thereby to make the digital display appropriately bright according to various conditions. Therefore, reading of digital display can be facilitated at all times, and electric power can be saved by avoiding unwanted power consumption.

For instance, the following are made possible; to lighten the digital display in the daytime in which it is light; to darken the display at night in which it is dark; to lighten the display when the environment in a room is light; to darken when the environment in a room is dark; to lighten the display when a dial having a lower optical transmittance is used; to darken when a dial having a higher optical transmittance is used; to darken the display when the battery has not been consumed; and to lighten the display when the battery has been consumed.

According to the invention described in claims 26 to 28, in the watch that has an electric circuit including: a battery; a control CPU that accepts supply of an electric power from the battery; and a controlled part that is made to work by the control CPU, when the control CPU makes the controlled part work, the voltage in the circuit is raised by a charger pump, and an output of the charger pump is fed back to a power source terminal of the control CPU. As a result, it becomes possible to move up ahead the use of the battery capacity, which has been out of use to the end conventionally. Further, the remaining capacity of the battery can be used until reaching a smaller amount, whereby the battery life can be extended.

In addition, when the watch includes a means capable of setting flow of electric current, which prevents a flow from the battery to the control CPU and a flow from the charger pump from being mixed, the direction of the current can be fixed thereby to prevent a reverse current to the battery, and therefore the voltage raised by the charger pump can act on only the control CPU effectively.

REFERENCE NUMERALS AND SIGNS

13: ANALOG MOVEMENT
15: HAND-MOVING SHAFT
16: CIRCUIT BOARD
17: THIN CHIP LED (LED FOR DIGITAL DISPLAY)
19: COLON
22: LIGHT-SHIELDING PLATE
23: LIGHT-TRANSMITTING HOLE
24: DIAL
30: SECONDARY BATTERY
32: SECONDARY COIL
33: LED DRIVE CIRCUIT
35: CROWN
36: CORE
40: RESIN PLATE
42: COLOR PRINT
43: LIGHT-DIFFUSING WHITE PRINT
44: ASPERITY
45: LIGHT-DIFFUSING PRINT
50: LIGHT-DIFFUSING COAT
51: LIGHT-SHIELDING COAT
60: LIGHT-SOURCE-DUTY-ADJUSTABLE CONTROL CIRCUIT
61: MICROCOMPUTER
62: TIME DATA
63: LIGHT SOURCE DRIVE CIRCUIT
64: DISPLAY PART
65: PHOTOSENSOR
66: PHOTOSENSOR DATA
67: DIAL OPTICAL TRANSMITTANCE DATA
68: DETECTED VOLTAGE DATA
70: CONTROL CPU
71: CONTROLLED PART
72: DIGITAL DISPLAY PART
73: CHARGER PUMP
74: INPUT PART
75: DIODE (MEANS FOR SETTING FLOW OF ELECTRIC CURRENT)
h: CENTRAL HOLE OF CIRCUIT BOARD
DIG11, DIG12, DIG13, DIG14: NUMERAL DISPLAY

Best Mode of Carrying out the Invention

Best modes which embody the invention will be described below with reference to the drawings.

Figure 1:
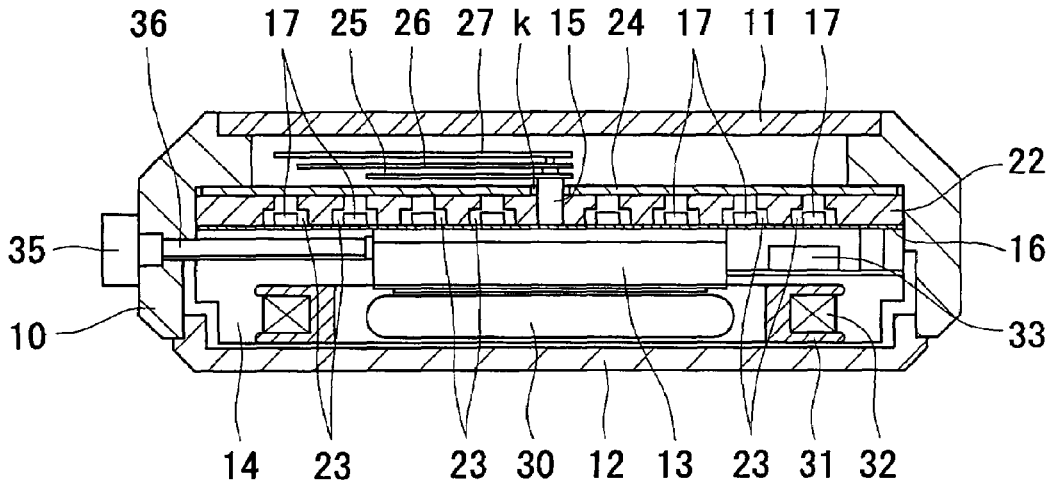
FIG. 1 It is a schematic lengthwise sectional view of an analog watch capable of performing digital display in association with the invention.

FIG. 1 shows an analog watch capable of performing digital display.

The watch shown in the drawing has a windshield 11 secured to a front side of the watch case 10 and a rear cover 12 screwed to a rear side thereof. The rear cover 12 is constructed of a nonmagnetic material, such as plastic, a metal except a ferromagnetic material, or the like.

The watch case 10 houses an analog movement 13 fixed by an inside frame 14 made of a resin. The movement 13 has hand-moving shafts 15 for hour, minute and second hands provided at its center upright and concentrically. In addition, a disk-shaped circuit board 16 is superposed on the movement 13. Also, the circuit board 16 is mounted with thin chip LEDs (LEDs for digital display) 17 measuring e.g. 1.6 mm or less in length, 0.8 mm or less in width and 0.8 mm or less in thickness.

Figure 2:
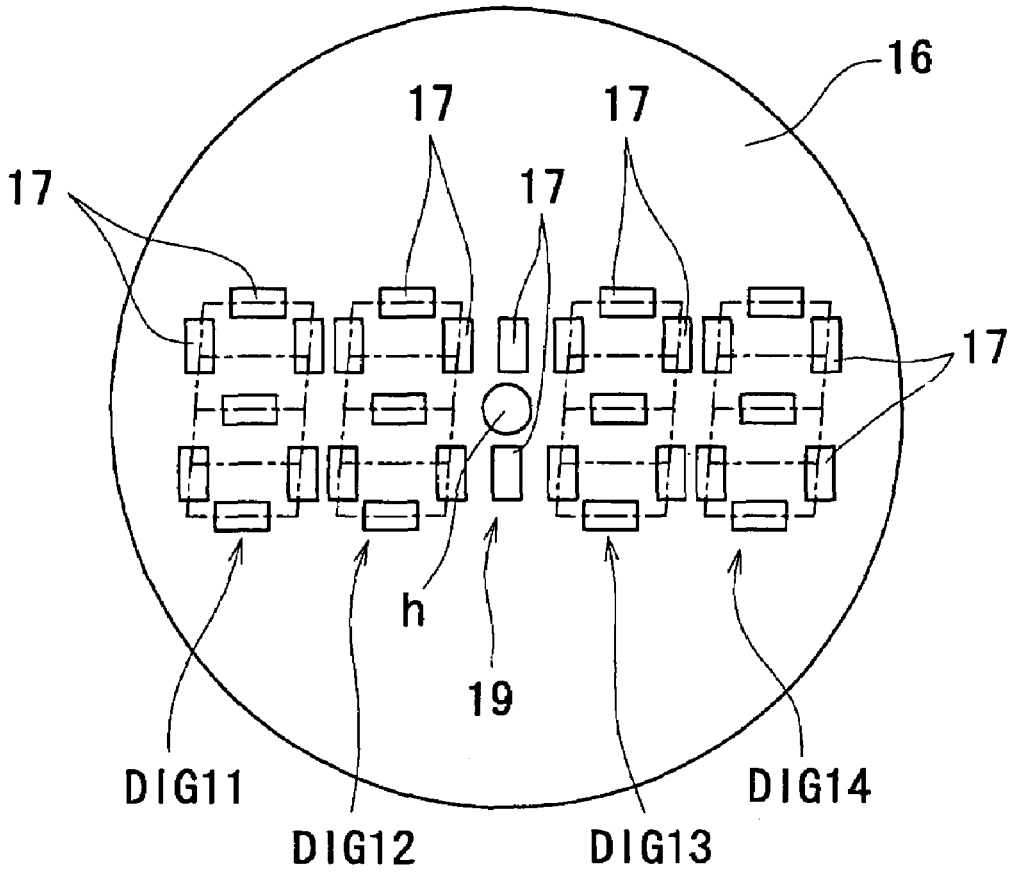
FIG. 2 It is a plan view of a circuit board used in the watch.

Then, as shown in FIG. 2, the LEDs 17 are laid out in sets of seven so that each set expresses the numerical character "8," forming numeral displays DIG11, DIG12, DIG13 and DIG14. The four numeral displays DIG11, DIG12, DIG13 and DIG14 are arrayed two-dimensionally in a line. The circuit board 16 has a central hole "h" made at its center. A pair of the LEDs 17 provided above and below the central hole "h," i.e. on opposite sides of the hole respectively so as to sandwich the hole is used to form a colon 19. The numeral displays DIG11, DIG12 and DIG13, DIG14 are allocated on left and right sides of the colon 19 in pairs so as to sandwich the colon therebetween.

Figure 3:
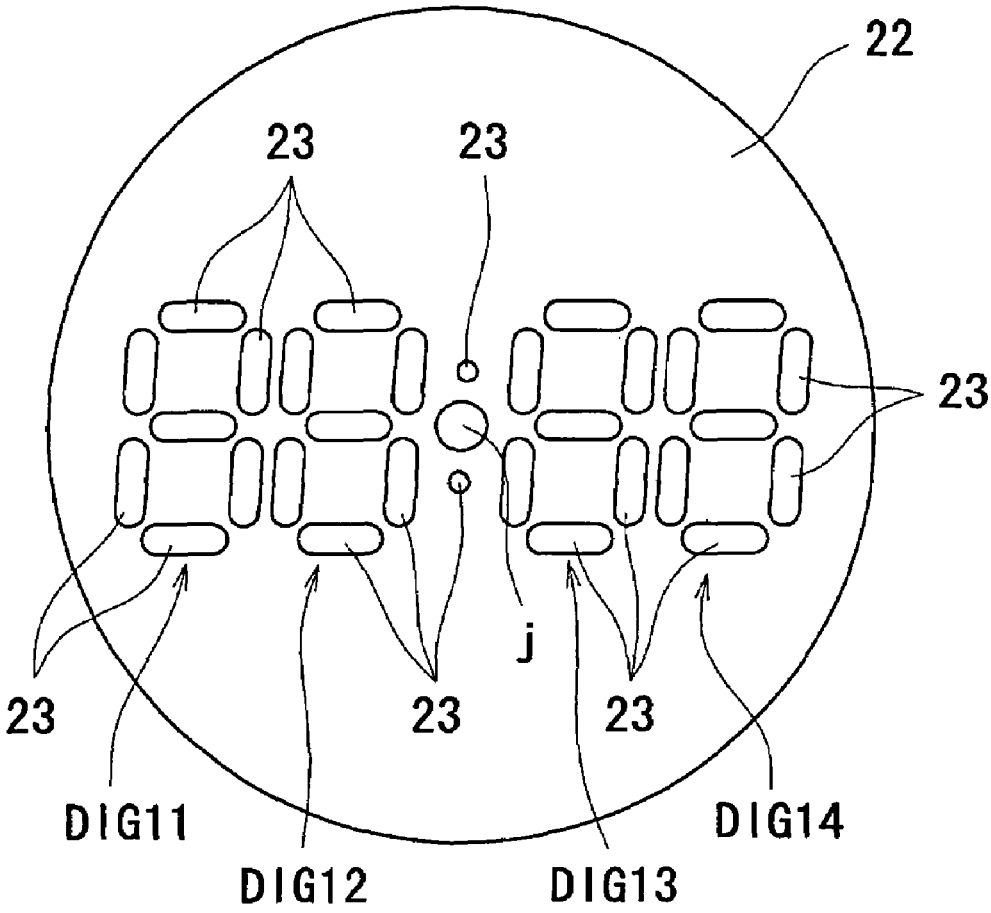
FIG. 3 It is a plan view of a light-shielding plate used in the watch.

As shown in FIG. 1, the circuit board 16 is put together and mounted on a light-shielding plate 22 somewhat thicker in comparison to the circuit board, and supported by the light-shielding plate 22. As shown in FIG. 3, the light-shielding plate 22 has elongated light-transmitting holes 23 that are made so as to opposed to the thin chip LEDs 17 on the circuit board 16. The light-transmitting holes 23 are bored through the light-shielding plate from its front to rear, and provided in heptads so as to align with the numeral displays DIG11, DIG12, DIG13 and DIG14. Thus, the light-transmitting holes are arranged so that one LED 17 is inserted in each light-transmitting hole 23 when the circuit board 16 is mounted on the rear side of the light-shielding plate, as shown in FIG. 1. The circuit board 16 and light-shielding plate 22 are arranged so that even when the circuit board is superposed on the light-shielding plate, the resulting combination measures 1.5 mm or less in thickness.

Figure 4:
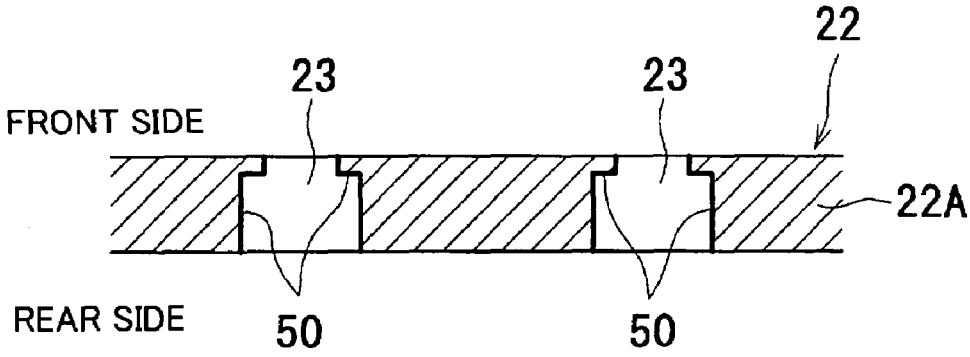
FIGS. 4(A) and 4(B) They are each a partial lengthwise sectional view, showing an example of arrangement of the light-shielding plate.
Figure 4:
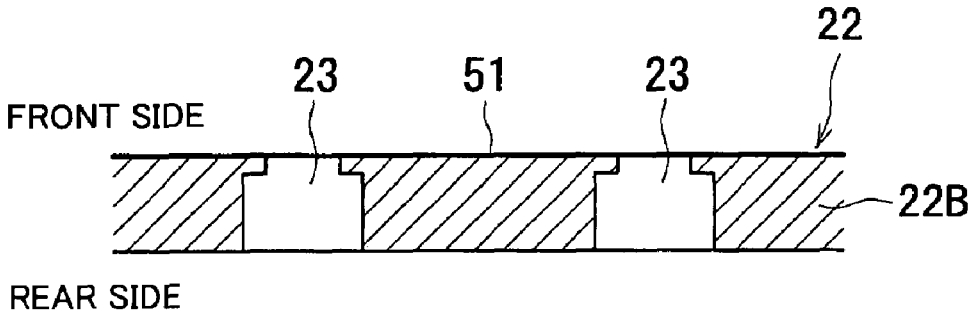

For example, as shown in FIG. 4(A), the light-shielding plate 22 is formed by using a plate-like resin member 22A of a deep color such as black having a high light-shielding ability and applying a light-diffusing coat 50, e.g. a white coat, to an inner face of each light-transmitting hole 23 made in the resin member 22A. Then, light having passed through the light-transmitting hole 23 is reflected and diffused by the inner face of the light-transmitting hole 23 coated with the coat 50, uniformly illuminating a rear face of a dial 24, which is to be described later.

Also, the light-shielding plate 22 may be formed by using a plate-like resin member 22B having a high photo reflectance and applying a light-shielding coat 51 to a front face of the resin member 22B, as shown in FIG. 4(B). Then, light passing through the light-transmitting hole 23 is reflected and diffused by an inner face of the light-transmitting hole 23 made in the resin member 22B with a high photo reflectance, uniformly illuminating the rear face of the dial 24, which is to be described later.

Thus, light passing through the inside of the light-transmitting hole 23 of the light-shielding plate 22 can be reflected and diffused by the inner face of the light-transmitting hole 23 thereby to uniformly illuminate the rear face of the dial 24, which enables generally uniform and clear digital display without partially causing non-uniformity of contrast.

As shown in FIG. 1, the dial 24 having a time display including a time numeral and a time-related character on its surface is superposed on the light-shielding plate 22. The dial 24 is formed by applying a coat to a surface of a transparent material made of plastic, glass or the like by printing, etc., for example. Alternatively, the dial 24 may be formed with a colored semitransparent material made of plastic, glass or the like so as to have an optical transmittance that allows digital display by the LEDs 17 for digital display to be visually identified through the dial 24 only when the LEDs 17 are ON. It is preferable that the optical transmittance be 1-70%. The periphery of the dial 24 is made to abut against a parting portion of the watch case 10, and then the whole of the resulting combination of the dial and the light-shielding plate is housed in the watch case 10.

Figure 5:
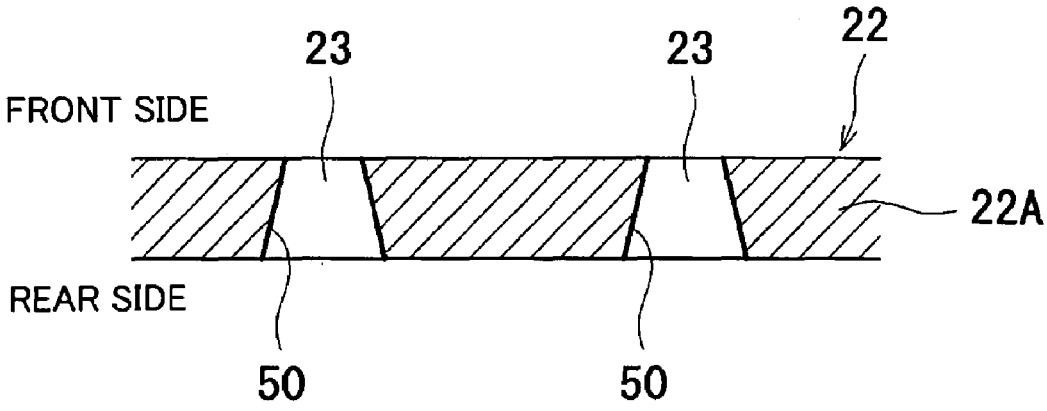
FIGS. 5(A) and 5(B) They are each a partial lengthwise sectional view, showing another example of arrangement of the light-shielding plate.
Figure 5:
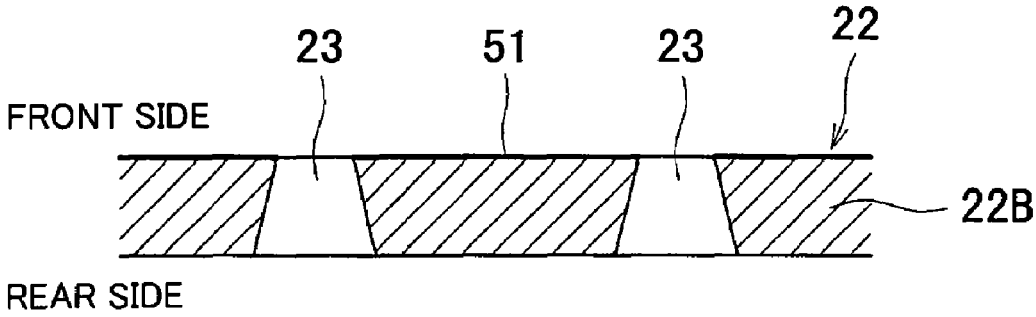

In the examples shown in FIGS. 4(A) and 4(B), the light-shielding plate 22 is formed so that each light-transmitting hole 23 is uniform in width from its rear side (i.e. the side near the circuit board 16) toward the front side (or the side of the dial 24), but have a narrower width at its front side opening. However, as shown in FIGS. 5(A) and 5(B), the light-transmitting hole 23 may be formed so that the width is made narrower gently from the front side toward the rear side. When this arrangement is made, light passing through the inside of each light-transmitting hole 23 can be reflected and diffused by the inner face of the light-transmitting hole 23, and the light-transmitting hole 23 can be made narrower gently toward the dial 24, thereby making it possible to guide the light while gathering. As in the cases shown in FIGS. 4(A) and 4(B), the light-shielding plate 22 in (A) is formed by applying a light-diffusing coat 50 to an inner face of each light-transmitting hole 23 made in a plate-like resin member 22A having a high light-shielding ability. The light-shielding plate 22 in (B) is formed by applying a light-shielding coat 51 to a front face of a plate-like resin member 22B having a high photoreflectance.

Figure 6:
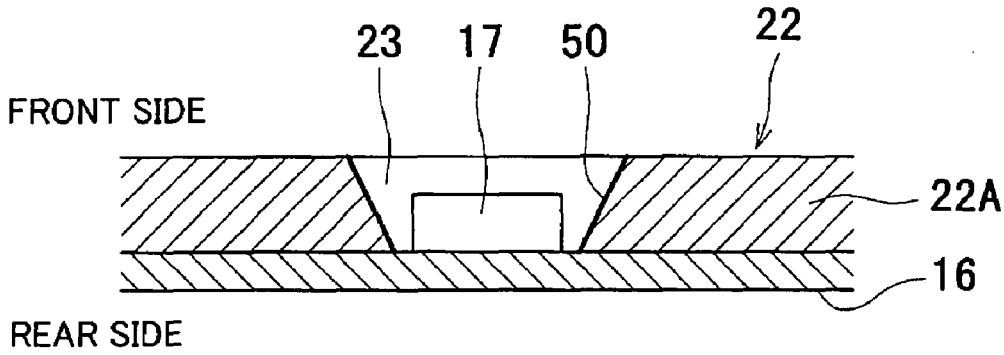
FIGS. 6(A) and 6(B) They are each a partial lengthwise sectional view of a light-transmitting hole taken along a direction of the length of the hole, showing another example of the arrangement.
Figure 6:
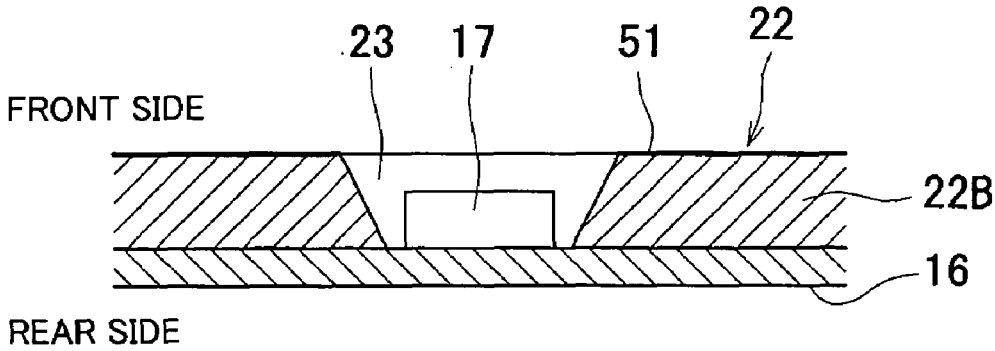

The light-shielding plate 22 may be formed so that the size of each light-transmitting hole 23 in its lengthwise direction is made larger gently from the rear side toward the front side, as shown in FIGS. 6(A) and 6(B). When this arrangement is made, light from each LED 17 mounted on the circuit board 16 can reflected and diffused by the inner face of the light-transmitting hole 23, and the size of the light-transmitting hole 23 in the lengthwise direction can be made longer gently toward the dial 24, whereby the reflected light can be led to the outside easily. As in the cases of the above-described examples, the light-shielding plate 22 in (A) is formed by applying a light-diffusing coat 50 to an inner face of each light-transmitting hole 23 made in a plate-like resin member 22A having a high light-shielding ability. The light-shielding plate 22 in (B) is formed by applying a light-shielding coat 51 to a front face of a plate-like resin member 22B having a high photoreflectance.

Figure 7:
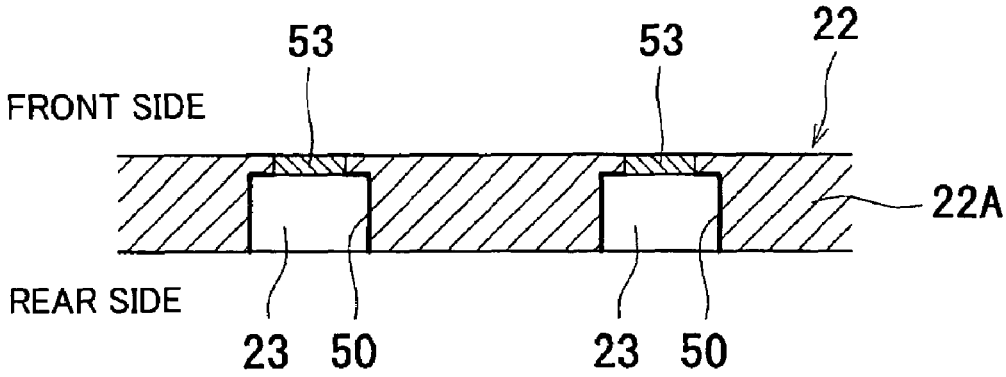
FIGS. 7(A) and 7(B) They are each a partial lengthwise sectional view, showing another example of the arrangement.
Figure 7:
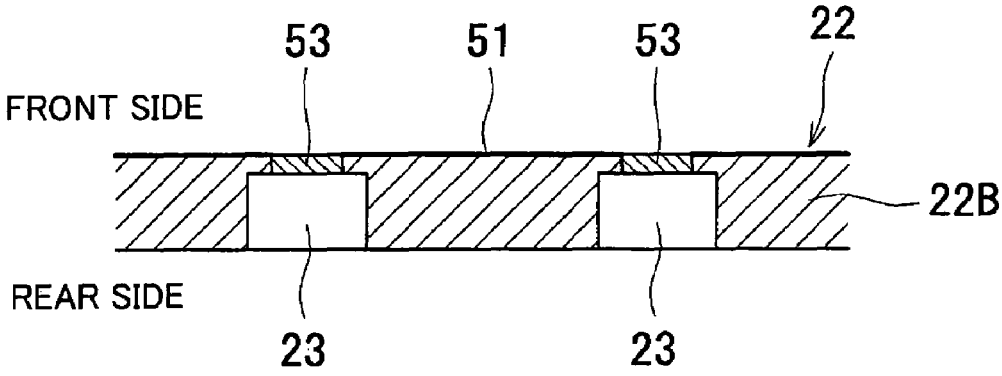

The light-shielding plate 22 may be formed so that a semitransparent resin 53 for diffusing light is fit in e.g. a front side opening of each light-transmitting hole 23 arranged to have a narrower width, as shown in FIGS. 7(A) and 7(B). The fitting of the semitransparent resin 53 for diffusing light may be performed before the light-shielding plate 22 is superposed on the circuit board 16, or after the light-shielding plate 22 has been superposed on the circuit board 16 followed by insertion of the LEDs 17 into the light-transmitting holes 23. Instead of the fitting, e.g. two-color molding may be used in forming the light-shielding plate thereby to form portions corresponding to the light-transmitting holes 23 from a resin of a color which tends to diffuse light. When this arrangement is made, light from the LEDs 17 can be diffused by the resin capable of diffusing light, and therefore the rear face of the dial 24 can be illuminated uniformly. Thus, a uniform and clear digital display can be presented. As in the cases of the above-described examples, the light-shielding plate 22 in (A) is formed by applying a light-diffusing coat 50 to an inner face of each light-transmitting hole 23 made in a plate-like resin member 22A having a high light-shielding ability. The light-shielding plate 22 in (B) is formed by applying a light-shielding coat 51 to a front face of a plate-like resin member 22B having a high photoreflectance.

Figure 8:
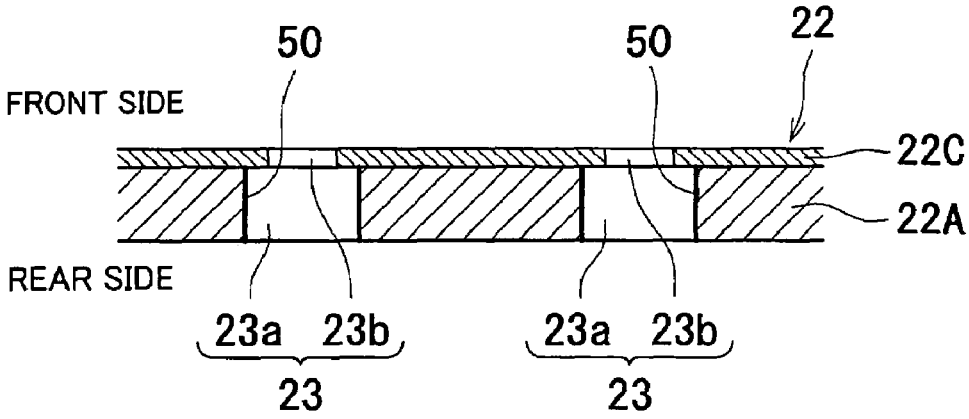
FIGS. 8(A) and 8(B)They are each a partial lengthwise sectional view, showing another example of the arrangement.
Figure 8:
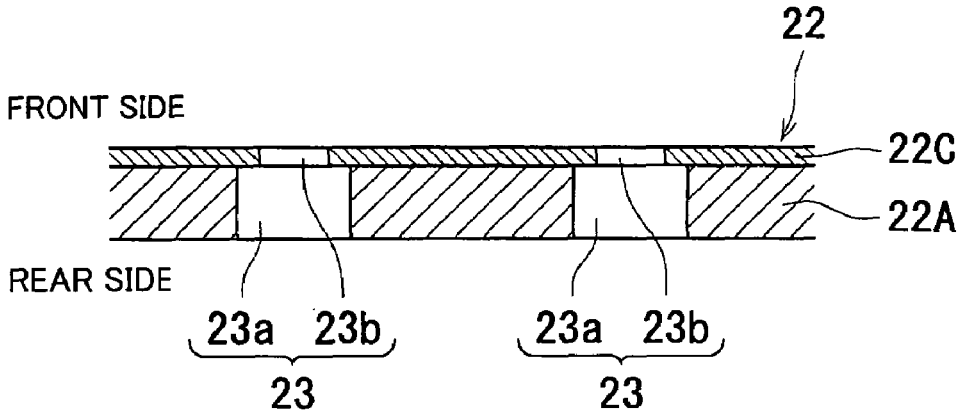

While in the above-described examples, the light-shielding plate 22 is formed with a single member, the light-shielding plate may be formed by putting two plate-like members together as shown in FIGS. 8(A) and 8(B). As for the resin member 22A or resin member 22B, which is a single plate-like member, a hole 23*a* for forming each light-transmitting hole 23 prevents the leakage of light from the LED 17 in a lateral direction. In regard to the thin metal member 22*C*, which is another plate-like member, a hole 23*b* for forming each light-transmitting hole 23 shapes the light from the LED 17 into a segment. The light-shielding plate 22 in (A) is formed by applying a light-diffusing coat 50 to an inner face of each hole 23*a* of the plate-like resin member 22A having a high light-shielding ability. The light-shielding plate 22 in (B) is formed with a plate-like resin member 22B having a high photoreflectance.

Figure 9:
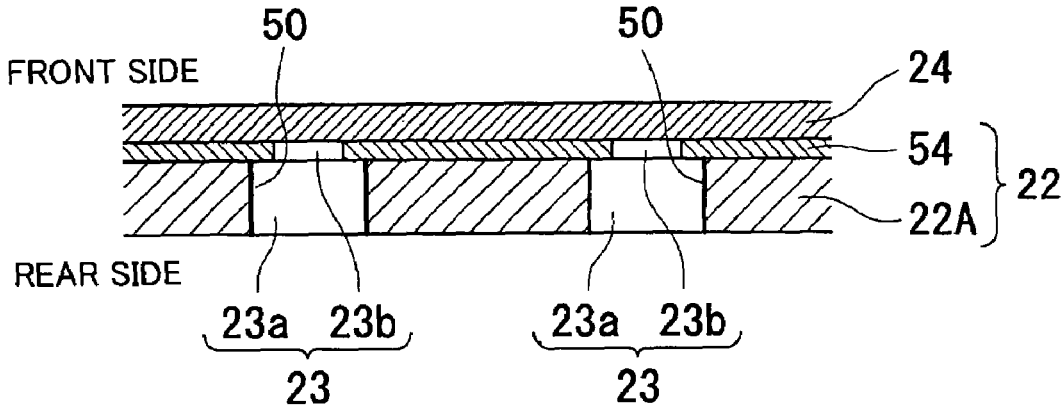
FIGS. 9(A) and 9(B) They are each a partial lengthwise sectional view, showing another example of the arrangement.
Figure 9:
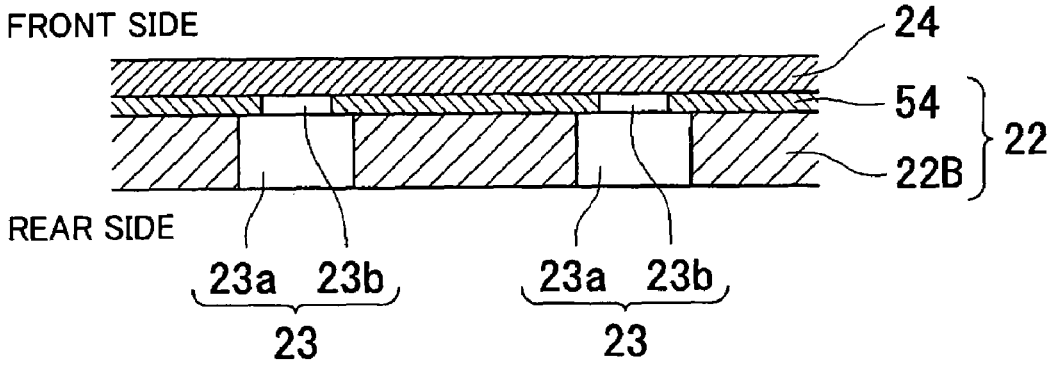

Now, instead of the metal member 22C, an arrangement including the following steps may be made as shown in FIGS. 9 (A) and 9(B): printing a light-shielding coat 54 on the dial 24; and providing a hole 23*b* for forming a light-transmitting hole 23 in the light-shielding coat 54. The light-shielding plate 22 in FIG. 9(A) is formed by applying a light-diffusing coat 50 to an inner face of a hole 23*a* for forming a light-transmitting hole 23, which the plate-like resin member 22A with a high light-shielding ability has. The light-shielding plate 22 in (B) is formed with a plate-like resin member 22B having a high photoreflectance and a hole 23*a* for forming the light-transmitting hole 23. One hole 23*a* for forming the light-transmitting hole 23 prevents the leakage of light from the LED 17 in a lateral direction, whereas the other hole 23*b* shapes the light from the LED 17 into a segment.

Figure 10:
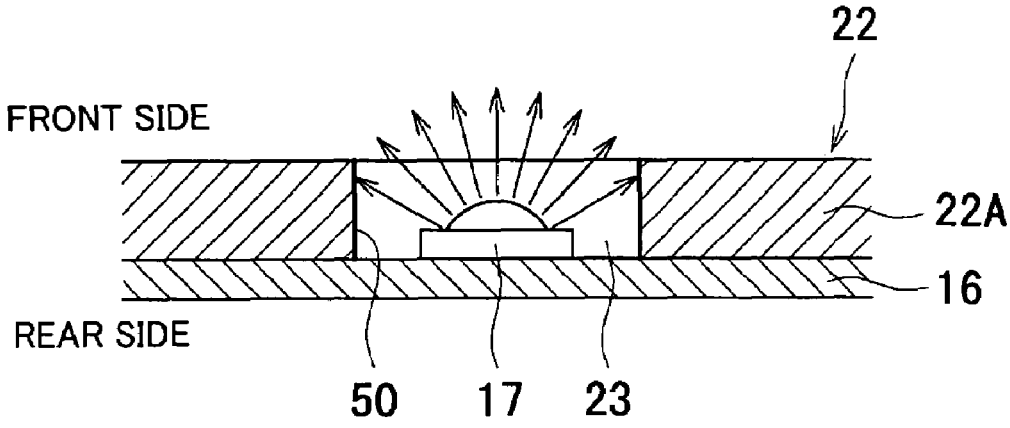
FIGS. 10(A) and 10(B) They are each a partial lengthwise sectional view, showing an example of the use of an LED equipped with a lens.
Figure 10:
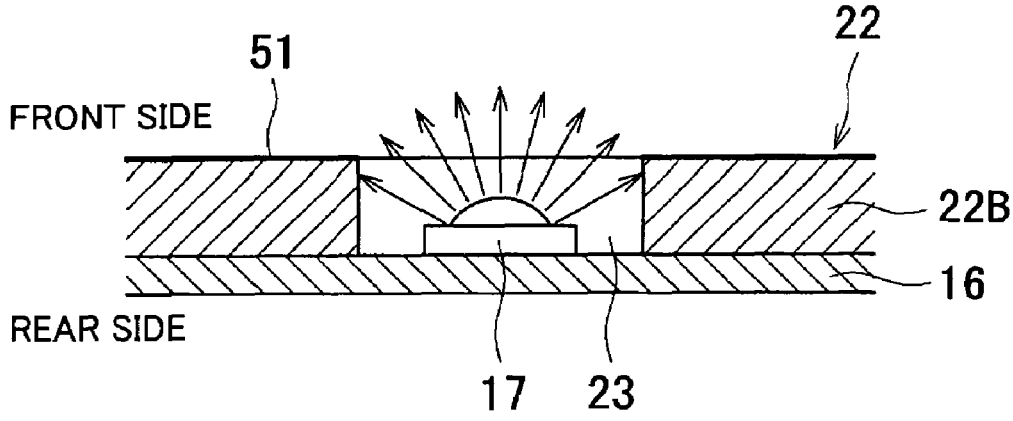

Now, as shown in FIGS. 10(A) and 10(B), when an LED 17 equipped with a custom-made lens which spreads light in a lengthwise direction thereof is used, light is spread inside the light-transmitting hole 23 to illuminate the rear face of the dial 24 uniformly, whereby a uniform and clear digital display can be presented. The light-shielding plate 22 in (A) is formed by applying a light-diffusing coat 50 to an inner face of a light-transmitting hole 23 of the plate-like resin member 22A with a high light-shielding ability. The light-shielding plate 22 in (B) is formed by applying a light-shielding coat 51 to a surface of a plate-like resin member 22B having a high photoreflectance.

Figure 11:
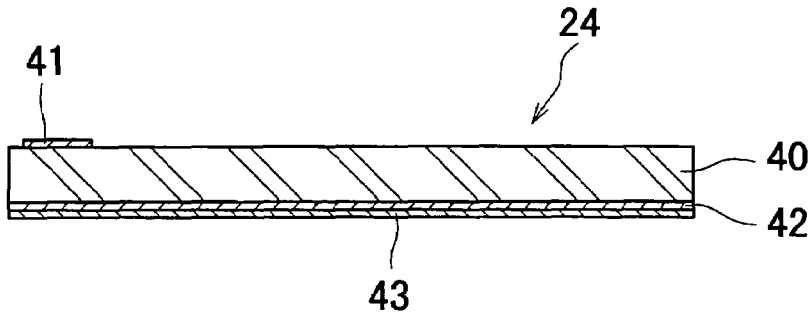
FIGS. 11(A), 11(B) and 11(C) They are each a lengthwise sectional view, showing an example of arrangement of a dial.
Figure 11:
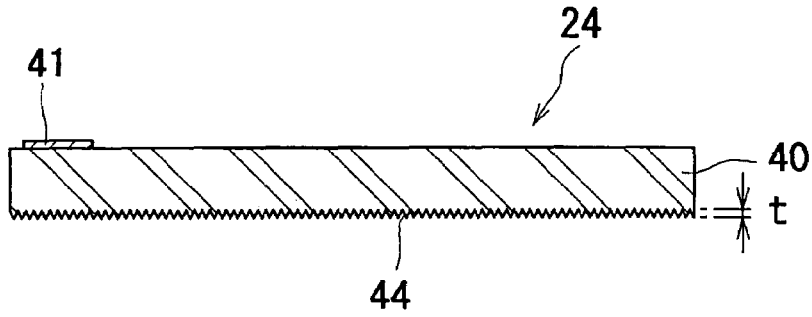
Figure 11:
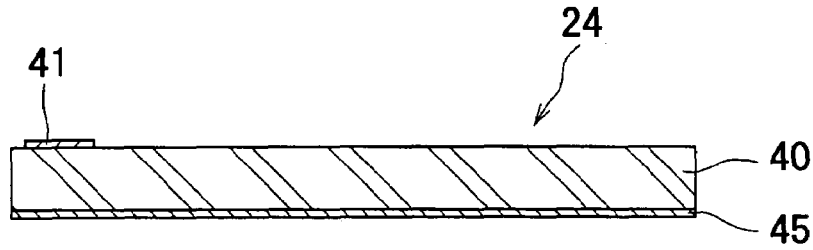

Meanwhile, at least locations of the dial 24 corresponding to the light-transmitting holes 23 undergo a light diffusion treatment. For example, as shown in FIG. 11(A), the dial 24 is formed by: providing a time display part 41 on a front face of a transparent resin plate 40; making a color print 42 on the rear face thereby to color a resin plate 40; and then making a light-diffusing white print 43 on the outside of it. As a matter of course, the print for diffusion of light is not limited to a white-colored ink, as long as it can diffuse light from the LEDs 17.

Also, an arrangement including the following steps may be made as shown in FIG. 11(B): making a resin plate 40 using a previously colored material; providing a time display part 41 on a front face of the resin plate 40; and forming an asperity 44 with a thickness t of several to several ten micrometers on the rear face for diffusing light. Further, as shown in FIG. 5(C), an arrangement including the following steps may be made: providing a time display part 41 on a front face of a resin plate 40 made using a previously colored material; and making a light-diffusing print 45 for diffusing light on the rear face. The light-diffusing prints 43, 45 and asperity 44 do not have to be provided on the entire surface of the resin plate 40, and they may be provided on at least locations corresponding to the light-transmitting holes 23.

Figure 12:
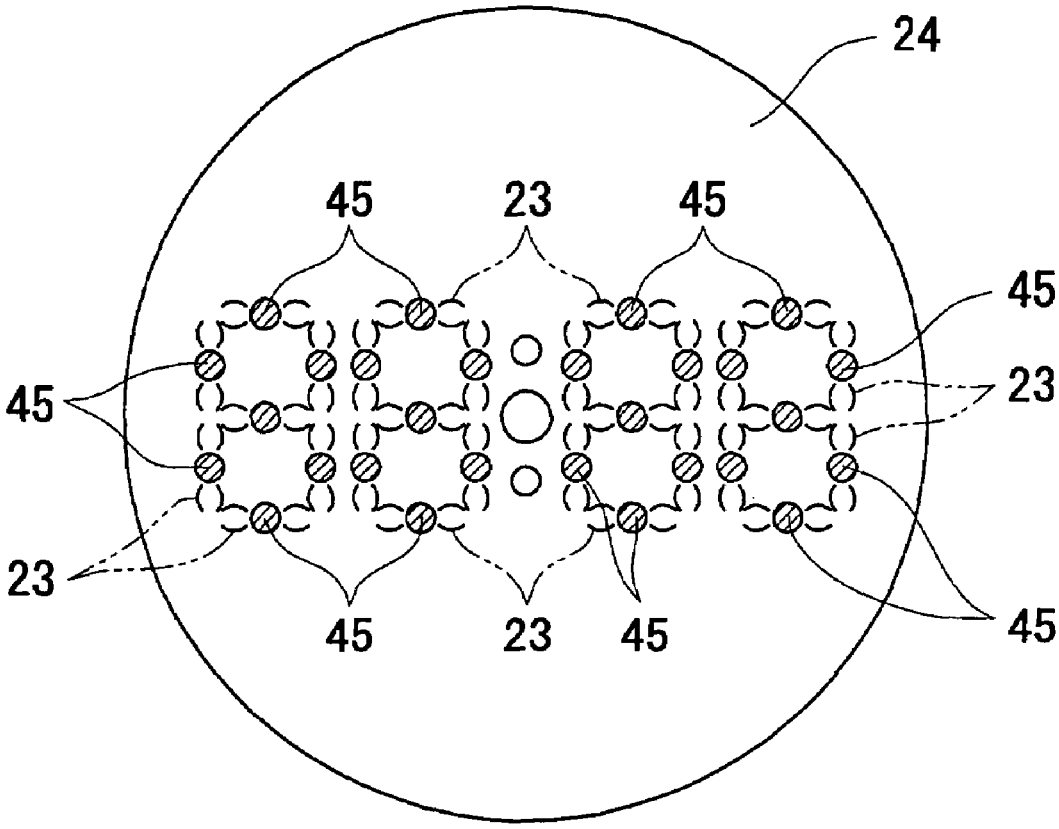
FIG. 12 It is a rear view, showing an example of arrangement of the dial, likewise.

For example, as shown in FIG. 12, a print 45 capable of diffusing light is made at a place nearest to the LED 17 on a rear portion of the dial 24 opposed to the light-transmitting holes 23. When this arrangement is made, the rear portion of dial 24 opposed to the light-transmitting holes 23 can be uniformly irradiated with light from the LED 17 regardless of whether the dial is near to or far from the LED 17 because the print 45 diffuses the light from the LED 17.

According to this way, as shown in FIG. 1, the light-shielding plate 22 is prepared on the rear side of the dial 24; the circuit board 16 is placed on the rear side of the light-shielding plate 22; and the movement 13 is provided on the rear side of the circuit board 16. Then, the LEDs 17 for digital display on the circuit board 16 are placed on the rear side of the dial 24.

The hand-moving shaft 15 extends from the central hole "h" of the circuit board 16 through a central hole of the light-shielding plate 22 (indicated by the reference sign "j" in FIG. 3) to a central hole of the dial 24 (indicated by the reference sign "k" in FIG. 1), and its leading end is exposed on the front side of the dial 24. To the leading end, an hour hand 25, a minute hand 26 and a second hand 27 are attached.

On the side of the movement 13 closer to the rear cover 12, a charging circuit is provided, and a coin type secondary battery 30 is placed so as to overlie the movement 13. Further, a secondary coil 32 is wound around a coil bobbin 31 annularly and thus mounted so as to surround the periphery of the secondary battery 30. In other word s, the secondary battery 30 and secondary coil 32 are laid out in the same plane inside the watch case 10 in the example shown in the drawing.

Figure 13:
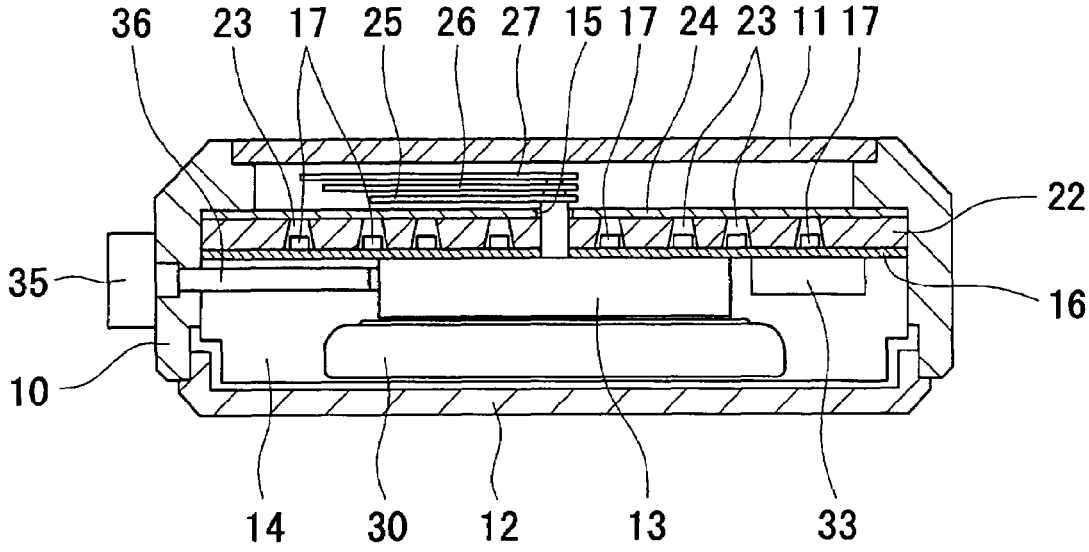
FIG. 13 It is a schematic lengthwise sectional view of another analog watch.

Also, on the rear side of the circuit board 16 in the watch case 10, an LED drive circuit 33 for driving the LEDs 17 is mounted in the same plane as the plane where the movement 13 is located. When the LED drive circuit 33 is mounted directly to the circuit board 16 on the rear side of the board as shown in FIG. 13, the space can be saved. The LED drive circuit 33 includes an LED drive module capable of turning on all the LEDs 17 based on an external operation. Also, the LED drive circuit includes an LED drive module capable of activating an additional clocking function e.g. a stopwatch, an alarm and a timer based on an external operation.

On the other hand, in the watch shown in the drawing, a core 36 having an outer end to which a crown 35 is attached is made to pierce through the watch case 10 and inserted into the movement 13. Likewise, an operation shaft having an outer end to which a switch button is attached is made to pierce through the watch case 10 and inserted into the movement 13, which is not shown in the drawing. In FIG. 13, parts corresponding to those in FIG. 1 are identified by the same reference numerals as numerals used for the parts in FIG. 1.

With the analog watch shown in the drawing, the LEDs 17 for digital display are not turned on normally. The secondary battery 30 drives the movement 13 to turn the hands 25-27, whereby the hands 25-27 are directed to time displays on the dial 24. Thus, the time is displayed in analog by the indication with the hands 25-27. The LEDs 17 are turned on according to an external operation appropriately on an as-needed basis, light from the LEDs 17 is guided by the light-transmitting holes 23 in the light-shielding plate 22 and made to pass through the dial 24, whereby the time, month and date, day of the week, etc. are displayed in digital. To correct the time, the crown 35 is manipulated to move the movement 13 through the core 36 thereby to turn the hands 25-27.

As stated above, as for a watch which performs digital display as well as analog display, the design restriction can be reduced to ensure the variety in design by: arranging the LEDs 17 so that they are not turned on normally; using the hands 25-27 to display the time in analog; hiding the LEDs 17 by the dial 24 out of view; and eliminating the need for making a digital display window in the dial 24. In addition, the LEDs 17 are turned on as required and then the time, month and date, day of the week, etc. are displayed in digital through the dial 24 and as such, a bright display can be achieved with various colors even in a poorly lit place. As a result, the disadvantages peculiar to a liquid crystal panel, such as the unattractive appearance of the display and the difficulty in seeing the display in a poorly lit place, can be eliminated on one hand; a digital display can be presented widely over the whole dial 24 with an increased visibility on the other hand.

Further, the colon 19 constituted by the LEDs 17 sandwiching therebetween the central hole "h" of the circuit board 16 is provided, and the numeral displays DIG11, DIG12, DIG13 and DIG14, each having the a set of LEDs 17 laid out so as to express the numerical character "8", are allocated in pairs sandwiching the colon 19 therebetween. As a result, the circuit board 16 having nearly the same size as that of the dial 24 can be used. Therefore, when the LEDs 17 are laid out over the whole circuit board 16, the entire plate surface of the dial 24 can be used effectively thereby to make digital display larger and easier to see.

In the example shown in the drawing, as lights from the LEDs 17 travel through the light-transmitting holes 23 of the light-shielding plate 22, impinge on the rear face of the dial 24, and pass through the dial 24, the outline of a displayed character can be defined distinctly by the light-transmitting holes 23, whereby digital display can be performed sharply and clearly. Also, lights from the LEDs 17 are reflected and diffused by the inner faces of the light-transmitting holes 23 of the light-shielding plate 22 when traveling through the inside of the light-transmitting holes 23, which makes it possible to present an entire digital display uniformly and clearly without partially causing non-uniformity of contrast in the light-transmitting holes 23.

Meanwhile, in the example shown in the drawing, as components including the dial 24, light-shielding plate 22, circuit board 16, analog movement 13, and LED drive circuit 33 are assembled compactly and housed in the watch case 10, the watch can be scaled down generally. Further, as in the analog watch shown in the drawing, the LEDs 17 constituting the colon 19 are provided so as to sandwich therebetween the central hole of the circuit board 16 which the hand-moving shaft 15 pierces through, the digital display can be provided in a center position of the dial 24. Therefore, a digital display as well as an analog display can be presented widely over the whole dial. Thus it becomes possible to present both digital and analog displays larger and easier to see.

In this case, the LEDs 17 are provided in one-to-one correspondence with the light-transmitting holes 23, and therefore the number of the LEDs 17 is minimized. As a result, the configuration of the drive circuit can be simplified, and the cost can be reduced. In addition, as the light diffusion treatment is performed on the dial 24 at least in locations corresponding to the light-transmitting holes 23, the portions subjected to the light diffusion treatment diffuse lights from the LEDs 17 and allow the lights to pass through the light-transmitting holes 23 uniformly. Therefore, even when the number of the LEDs 17 is reduced, clear digital display can be performed.

Also, as in the example shown in the drawing, the LED drive circuit 33 includes an LED drive module capable of turning on all the LEDs 17 according to an external operation, the LED drive circuit 33 can be made to work by an external operation to turn on all the LEDs 17 in a place where lighting is required as in the case where a keyhole or something is hard to see in a poorly lit place, for example. In addition, the secondary battery 30 can be used as a power source to illuminate the outside through the windshield 11, and the LEDs 17 for displaying the time, etc. can be utilized for illumination as they are. Therefore, it is possible to light the surroundings without an additional light source for illumination which would lead to the upsizing of the watch and worsening of the appearance thereof.

Further, in the example shown in the drawing, the LED drive circuit 33 includes an LED drive module capable of activating an additional clocking function e.g. a stopwatch, an alarm and a timer based on an external operation of a switch button that is not shown and as such, a watch which performs digital display as well as analog display can be extended in functionality, thereby to increase the added value thereof.

When the switch button that is not shown in the drawing is operated from the outside once again, the LEDs 17 are turned off. As a matter of course, a remaining illumination time may be set so that the LEDs 17 are turned off automatically when a certain length of time has elapsed after the switch operation. Also, a plurality of switch buttons may be provided instead of one switch button. In this case, the operation of the switch buttons may allow the display to be switched or the LEDs to be turned on/off.

Meanwhile, with the watch shown in the drawing, when the battery capacity of the secondary battery 30 has been lowered from use, the watch is put on a charger, which is not shown in the drawing, thereby to charge the battery by electromagnetic induction. Specifically, a primary coil of the charger is made to generate an alternating magnetic field by passing AC current, which is supplied through an AC cord, through the primary coil. Then, the alternating magnetic field is used to cause a secondary coil 32 of the watch shown in the drawing to generate alternating current. The alternating current is rectified by a rectification circuit and charged as direct current into the secondary battery 30.

As the secondary battery 30 is used as a power source, even when frequent use of the LEDs 17 has exhausted the battery, only charging the battery suffices instead of replacing the battery. Therefore, the illuminating function can be used fully without the need for paying attention to the battery life and bothering about the inconvenience for battery replacement and the cost therefor. As a result, it becomes possible to obviate the disadvantage posed by digital display performed with the LEDs 17 that consume a larger amount of electric power in comparison to liquid crystal panels.

In the example shown in the drawing, the secondary battery 30 of the charging circuit is charged by electromagnetic induction. However, the secondary battery 30 may be a solar battery. Otherwise, the secondary battery directly may be charged by directly connecting with a power source terminal. When the secondary coil 32 is prepared thereby to enable the charging of the secondary battery 30 by electromagnetic induction, simple and reliable charging can be achieved without being restricted in design and making the watertight structure more complicated.

Figure 14:
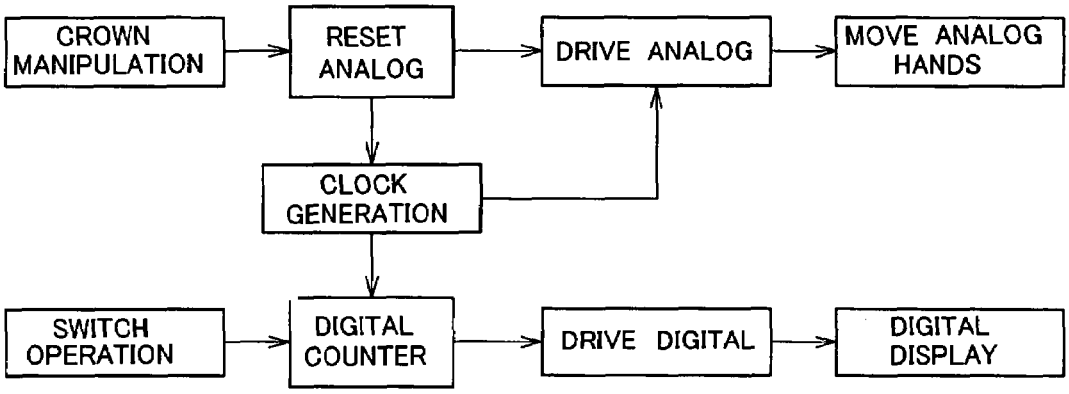
FIG. 14 It is an explanatory block diagram for correction of time for the analog watch shown in FIG. 1.

FIG. 14 presents a block diagram for explanation of correction of time with respect to the analog watch shown in FIG. 1.

Figure 15:
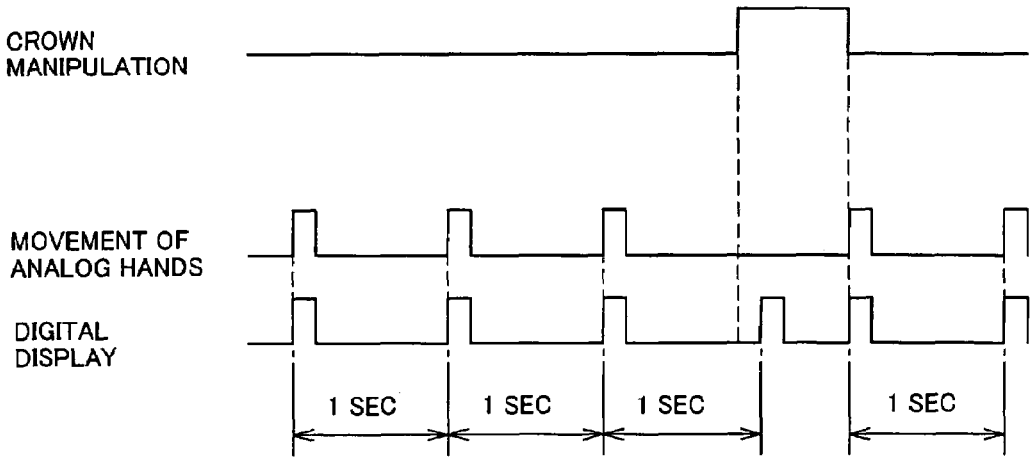
FIG. 15 It is a timing chart in analog time correction.

FIG. 15 presents a timing chart during the time of analog time correction.

As shown in the drawing, when the crown 35 is pulled in analog time correction, the movement is activated through the core 36 to reset the analog pulse. Then, the hands 25-27 are turned through the core 36 by rotating the crown 35, thereby adjusting the hands to a desired time. After that, the crown 35 is pushed down at an appropriate timing e.g. at the time of setting the time by the time signal or the like thereby to generate a clock pulse and therefore drive the analog. That is, moving of the analog hands is started concurrently with pushing down the crown 35.

Also, the clock pulse generated at the time of pushing down the crown 35 is input to a digital counter. Then, the counter counts up synchronously with start of analog hands' moving, and the digital is driven to match the digital display pulse timing with the analog hands-moving pulse timing.

Figure 16:
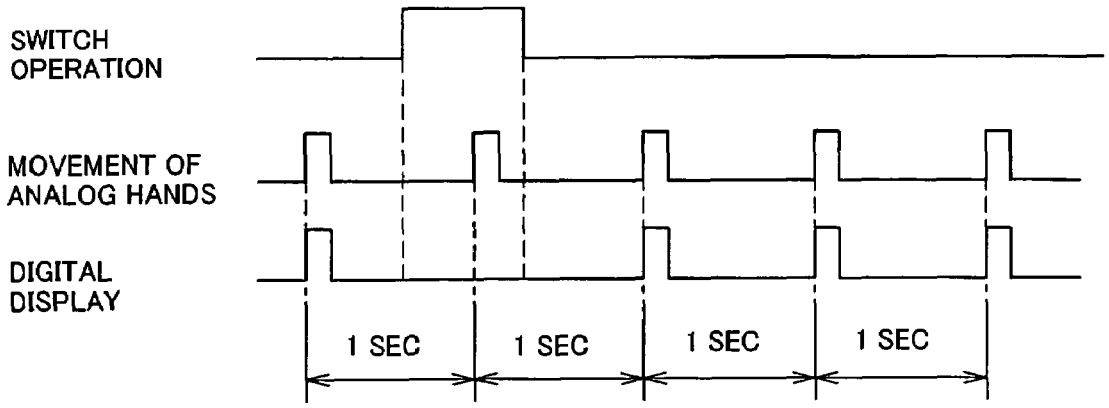
FIG. 16 It is a timing chart in digital time correction.

FIG. 16 presents a timing chart during the time of digital time correction.

Even when the switch button, which is not shown in the drawing, is operated in digital time correction, analog hands' moving is continued independently of the switch operation. However, the counter is caused to count up in synchronization with analog hands' moving on receipt of a switch-off operation of the switch, and the digital are driven thereby to match the digital display pulse timing with the analog hands-moving pulse timing.

Thus, in the example shown in the drawing in association with a watch that displays the time in both analog and digital, a control circuit controls the analog hands-moving pulse timing and digital display pulse timing so that they are brought into synchronization with each other. Therefore, the time difference between the analog display and digital display is obliterated thereby to increase the commercial value. Particularly in the example shown in the drawing in association with a watch that displays the time in analog and digital according to a led-by-analog way, it is possible to make an arrangement such that correction of the analog time that is a lead is not performed in correction of the digital time as an additional function.

Figure 17:
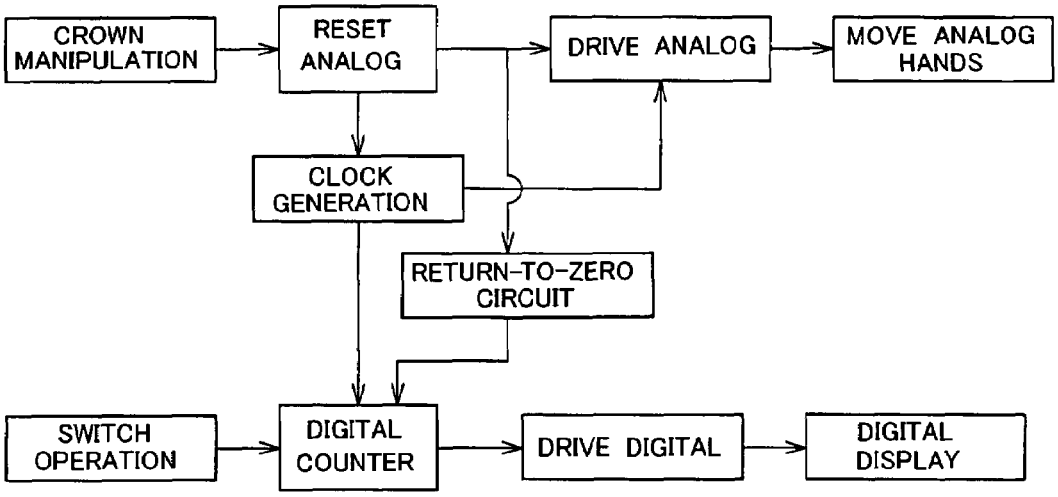
FIG. 17 It is a block diagram when 30-second rounding of digital display is performed in analog time correction.

FIG. 17 presents a block diagram in the case where the digital display is subjected to 30-second rounding in analog time correction.

As shown in the drawing, when the crown 35 is pushed down, the movement is activated through the core 36 to reset the analog pulse, and a return-to-zero circuit is activated. Then, when the counted number of the digital counter in seconds is below 30, the digital counter is caused to count down, and the second's place of the counter is returned back to zero. In contrast, when the counted number of the digital counter in seconds is equal to or above 30, the counter is made to count up and the second's place of the counter is returned back to zero. In addition, when the crown 35 is pushed down in the same manner, the digital counter counts up synchronously with start of analog hands' moving, and the digital is driven to match the digital display pulse timing with the analog hands-moving pulse timing. When the digital display is made to return back to zero according to the 30-second rounding, efforts to correct the time in seconds can be eliminated.

Figure 18:
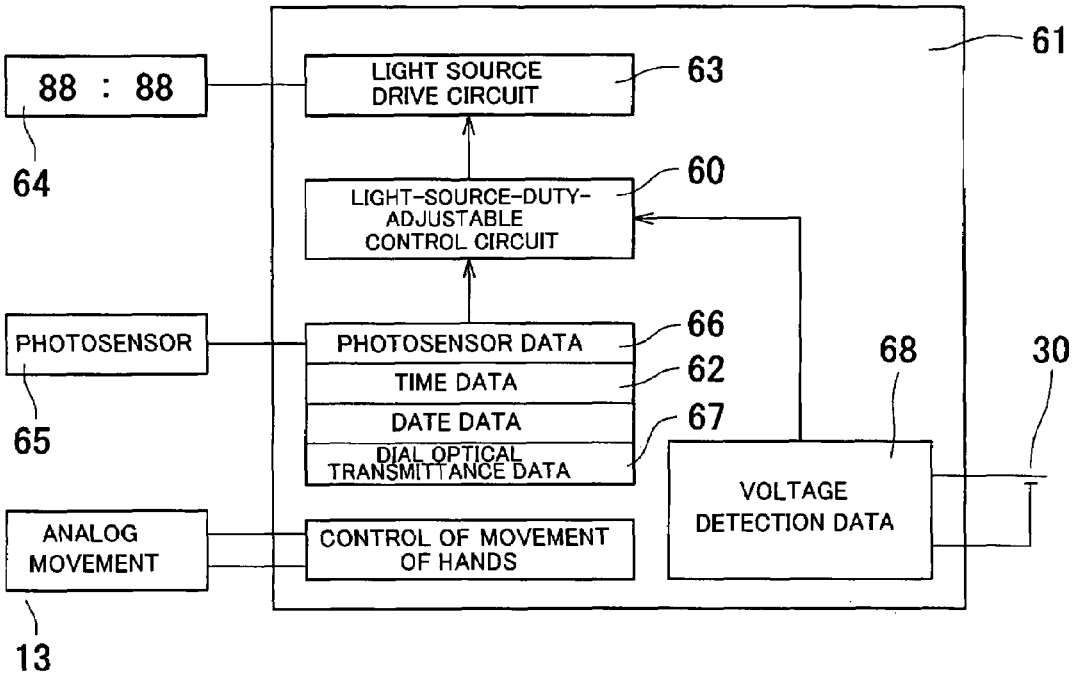
FIG. 18 It is a block diagram of the analog watch shown in FIG. 1.

FIG. 18 presents a block diagram of the watch stated above.

The watch shown in the drawing includes a light-source-duty-adjustable control circuit 60 that can adjust the duty ratio. The duty ratio is a ratio of a lighting time during which LED 17 stays on with respect to the total display time during which digital display is performed. According to various conditions, the control circuit 60 changes the duty ratio of each LED 17 thereby to make the digital display appropriately bright.

For instance, pieces of information obtained from the analog and digital clocking functions are kept in a microcomputer 61 as time data 62. The time data 62 are input to the light-source-duty-adjustable control circuit 60. The duty ratio of each LED 17 is adjusted based on the time data 62, and then the light source drive circuit 63 is driven thereby to force the display part 64 to perform digital display.

Figure 19:
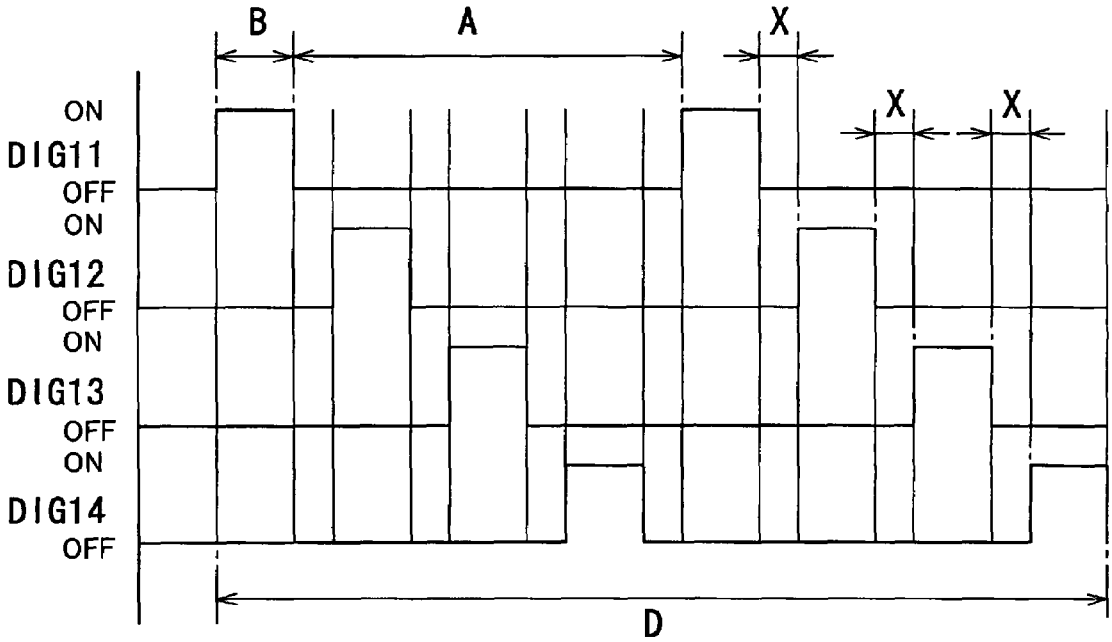
FIG. 19 It is a drive timing chart of numeral displays in a digital display part.

FIG. 19 shows drive timings of the numeral displays DIG11, DIG12, DIG13 and DIG14 in the display part 64.

As shown in the drawing, the numeral displays DIG11, DIG12, DIG13 and DIG14 are each turned on intermittently for a time "B" at constant intervals "A" as in the past. Moreover, the numeral displays DIG11, DIG12, DIG13 and DIG14 are shifted by a time "X," switched and turned on in turn. Thus, the display part 64 performs display for a time "D" totally.

In the watch shown in the drawing, the control circuit 60 can adjust the duty ratio by e.g. changing its light source break time "X". The time data 62 are used to make the judgment on it is in daytime or nighttime. In the daytime with light surroundings, the light source break time "X" is shortened thereby to make digital display lighter, whereas in the nighttime with dark surroundings, the light source break time "X" is elongated thereby to make the digital display darker. Thus, the digital display is made easier to see. Naturally, when the light source break time "X" is zero (0), the duty ratio is 100% and therefore the digital display is made lightest.

Figure 20:
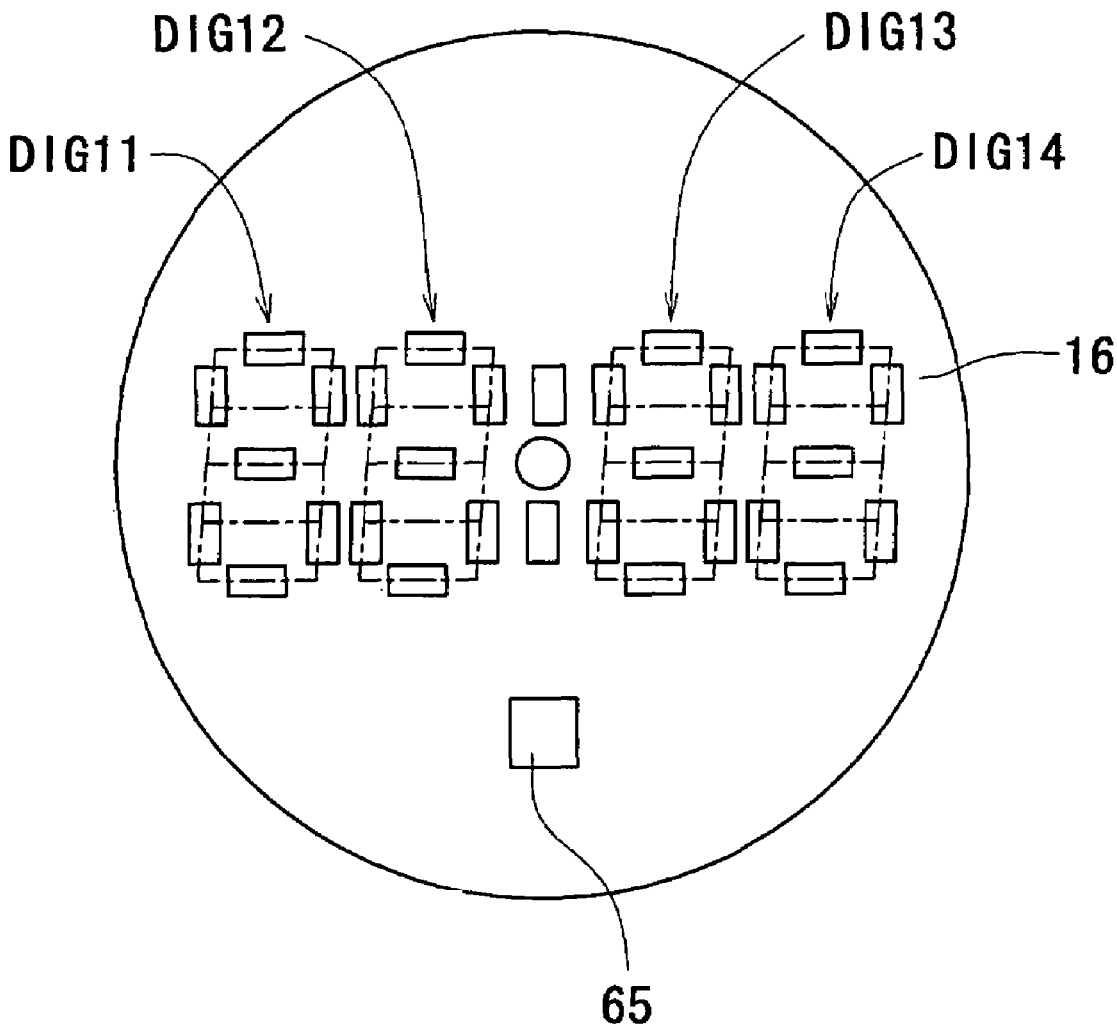
FIG. 20 It is a plan view of a circuit board in another example.

Also, as shown in FIG. 20, for example, the watch may have a photosensor 65 mounted on the circuit board 16 on the rear side of the dial 24. An output signal from the photosensor 65 is entered into the microcomputer 61 and kept as photosensor data 66, as shown in FIG. 18. The photosensor data 66 is input to the light-source-duty-adjustable control circuit 60. The duty ratio of each LED 17 is adjusted based on the photosensor data 66, and then the light source drive circuit 63 is driven thereby to force the display part 64 to perform digital display.

Then, the built-in photosensor 65 is utilized to sense a room environment, and the brightness inside the room is judged based on the photosensor data 66. When the room is light, the light source break time "X" is shortened thereby to make digital display lighter. When the room is dark, the light source break time "X" is elongated thereby to make the digital display darker and therefore to make the digital display easier to see.

Further, the optical transmittance of the dial 24 is input to the microcomputer 61 and stored therein as dial optical transmittance data 67, as shown in FIG. 18. The dial optical transmittance data 67 is input to the light-source-duty-adjustable control circuit 60. The duty ratio of each LED 17 is adjusted based on the dial optical transmittance data 67, and then the light source drive circuit 63 is driven to force the display part 64 to perform digital display.

Then, the optical transmittance of the dial 24 in use is judged based on the dial optical transmittance data 67. When a dial with a lower optical transmittance is used, the light source break time "X" is shortened thereby to make the LEDs 17 lighter. When a dial with a higher optical transmittance is used, the light source break time "X" is elongated thereby to make the digital display darker and therefore to make the digital display easier to see.

Still further, the voltage of the secondary battery 30 may be detected by a voltage-detecting element built in the circuit. The detected voltage is stored in the microcomputer 61 as detected voltage data 68. The detected voltage data 68 is input to the light-source-duty-adjustable control circuit 60. The duty ratio of each LED 17 is adjusted based on the detected voltage data 68, and then the light source drive circuit 63 is driven to force the display part 64 to perform digital display.

Then, when the detected battery voltage is at Low, i.e. when the battery has been exhausted, the light source break time "X" is shortened thereby to make the digital display lighter. When the battery voltage is at High, i.e. when the battery has not been exhausted yet, the light source break time "X" is elongated thereby to make the digital display darker and therefore to make the digital display easier to see, concurrently reducing the current consumption.

While the case of the 4-digit digital display composed of the numeral displays DIG11, DIG12, DIG13 and DIG14 has been described as to the examples described above, the invention is not limited to 4 digits. The duty ratio can be determined by a combination of the conditions including time data, photosensor data, dial optical transmittance data, and detected voltage data, thereby making the digital display appropriately light.

Figure 21:
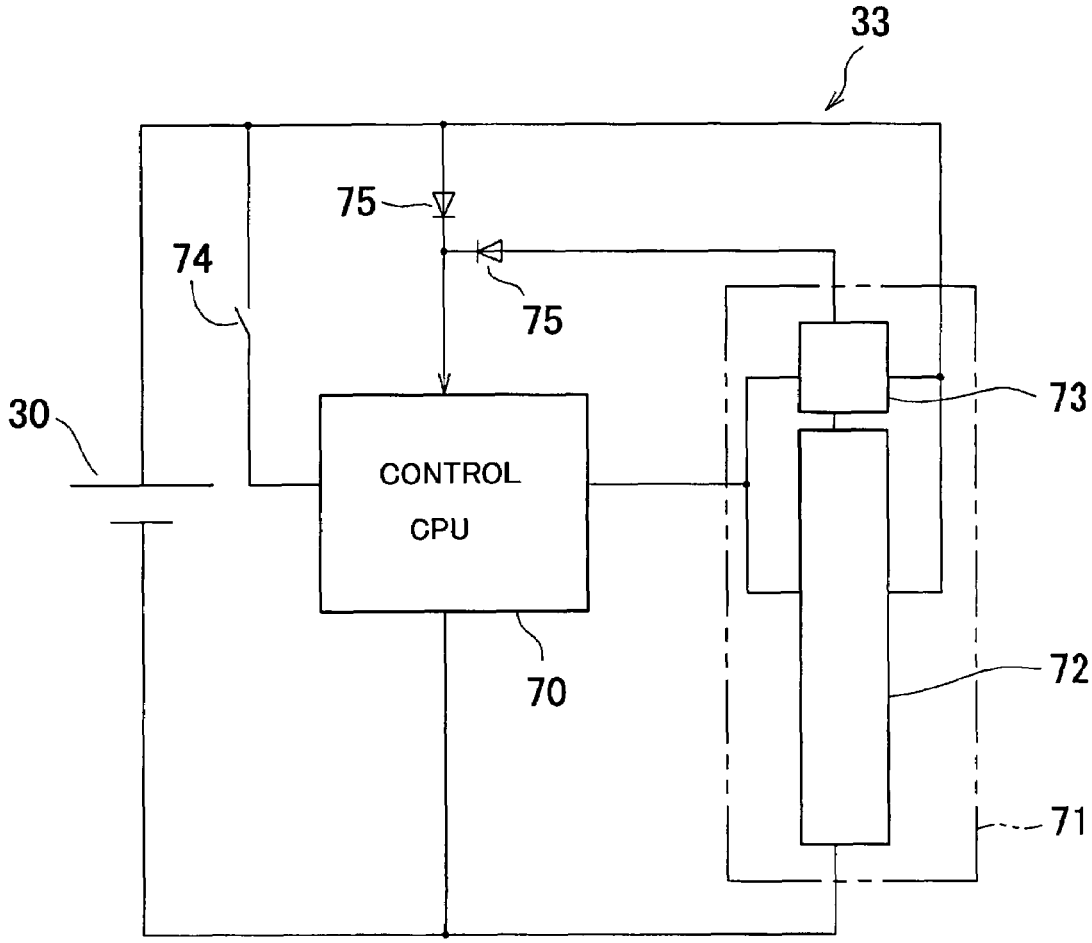
FIG. 21 It is a block diagram of an LED drive circuit of the analog watch shown in FIG. 1.

FIG. 21 presents a block diagram of the LED drive circuit 33 of the above-described watch.

In the drawing, the reference numeral 30 represents the above-described secondary battery. The reference numeral 70 represents a control CPU to which electric power from the secondary battery 30 is supplied. The reference numeral 71 represents a controlled part that accepts the supply of electric power from the secondary battery 30 and is turned ON/OFF and made to work by the control CPU 70. The controlled part 71 has a digital display part 72 and a charger pump 73. The digital display part 72 is configured of the above-described numeral displays DIG11, DIG12, DIG13 and DIG14 and colon 19, which are composed of thin chip LEDs (LEDs for digital display) 17.

The charger pump 73 is an element having the capability of changing an input of 3A at 1V into an output of 1A at 3V, for example, and converts current supplied from the secondary battery 30 into a predetermined voltage and then output the voltage. What value the charger pump has as its output voltage is specific for an element thereof. Therefore, a designer should select an appropriate element depending on its application. At the time when the control CPU 70 turns the controlled part 71 ON, the charger pump 73 is turned ON simultaneously. When the controlled part 71 is turned ON, its output is raised by charger pump 73 and fed back to the power source terminal of the control CPU 70.

The reference numeral 74 in FIG. 21 represents an input part for actuating the LED drive circuit 33. Specifically, it is composed of a switch button that is operated at the time of turning on the digital display part 72 thereby to activate the above-described operation shaft. When the switch operation is switched off, i.e. when the input part 74 is turned OFF, the control CPU 70 turns the controlled part 71 OFF thereby to terminate an action of the controlled part 71, then turning off the digital display part and bringing the display part back to its standby state.

The reference numeral 75 in FIG. 21 represents a diode that is a means for setting the flow of electric current. The diode 75 restricts the direction of current thereby to prevent the flow supplying an electric power to the power source terminal of the control CPU 70 from the secondary battery 30 and the flow feeding back the output of the charger pump 73 to the power source terminal of the control CPU 70 from being mixed. Thus, the diode 75 prevents the reverse current toward the secondary battery 30, whereby the voltage raised by the charger pump 73 can act on only the control CPU 70 effectively. Also, the diode prevents the voltage drop in the control CPU 70 from occurring and the timepiece circuit and additional function circuit from going out of operation when the digital display part 72 is operated.

Figure 22:
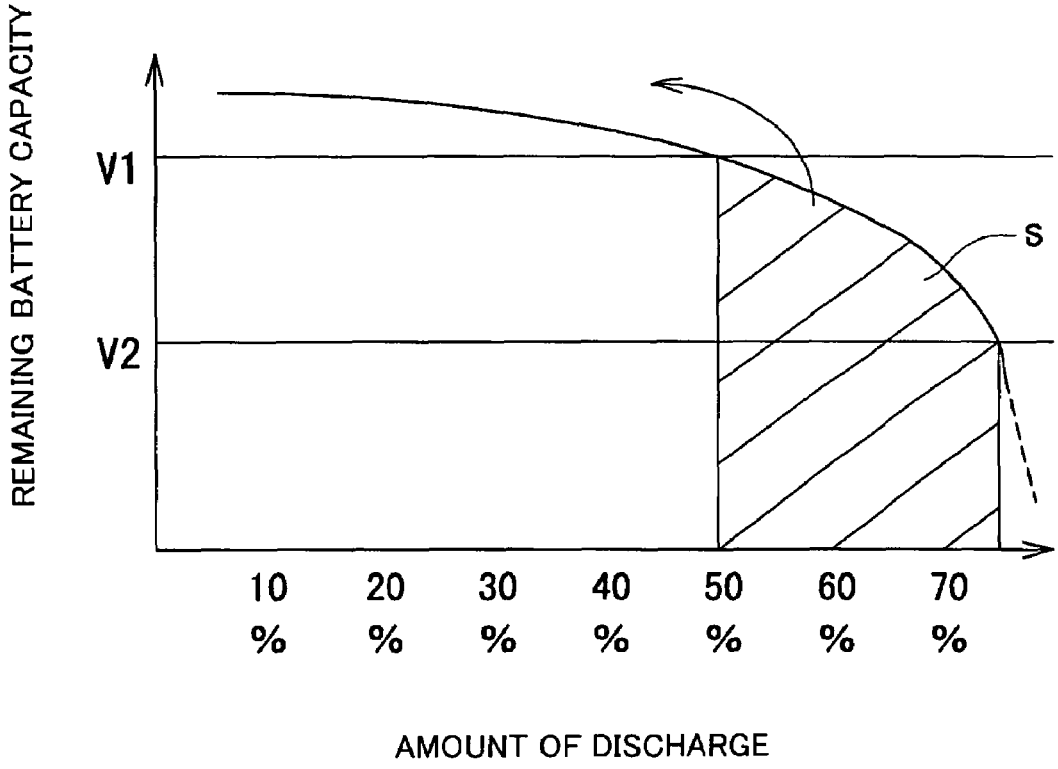
FIG. 22 It is a graph showing a battery discharge curve for explanation on the fact that use of a battery capacity is moved up ahead.
Figure 23:
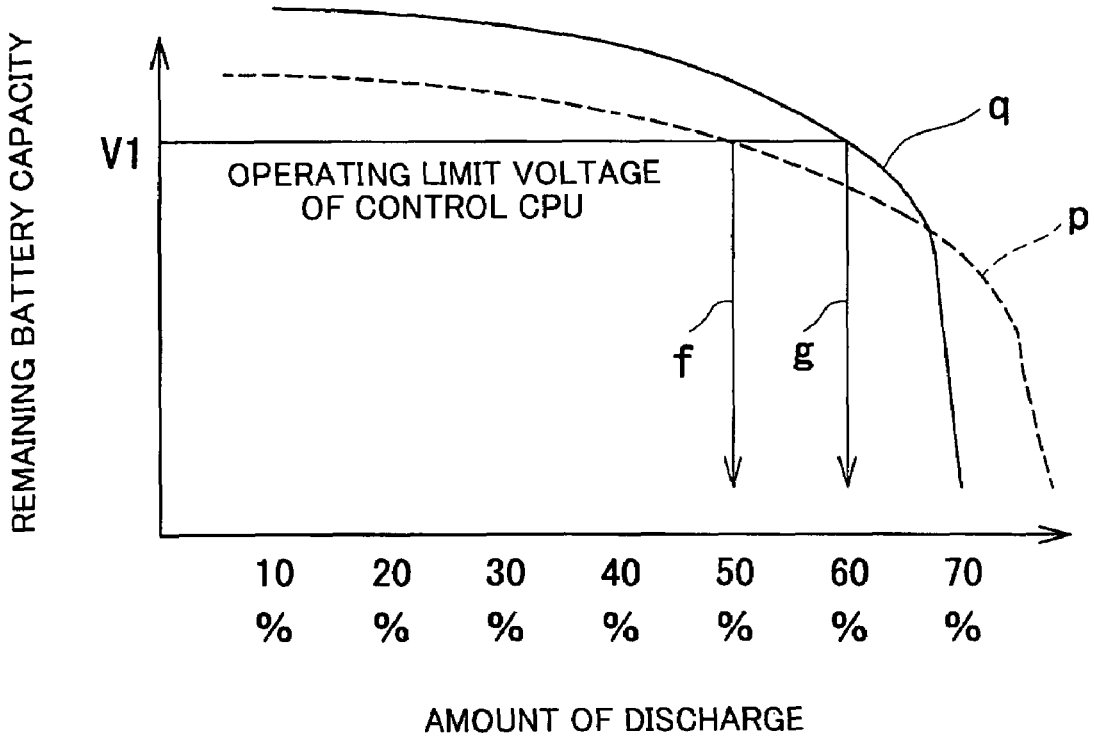
FIG. 23 It is a graph showing a battery discharge curve of the watch.
Figure 24:
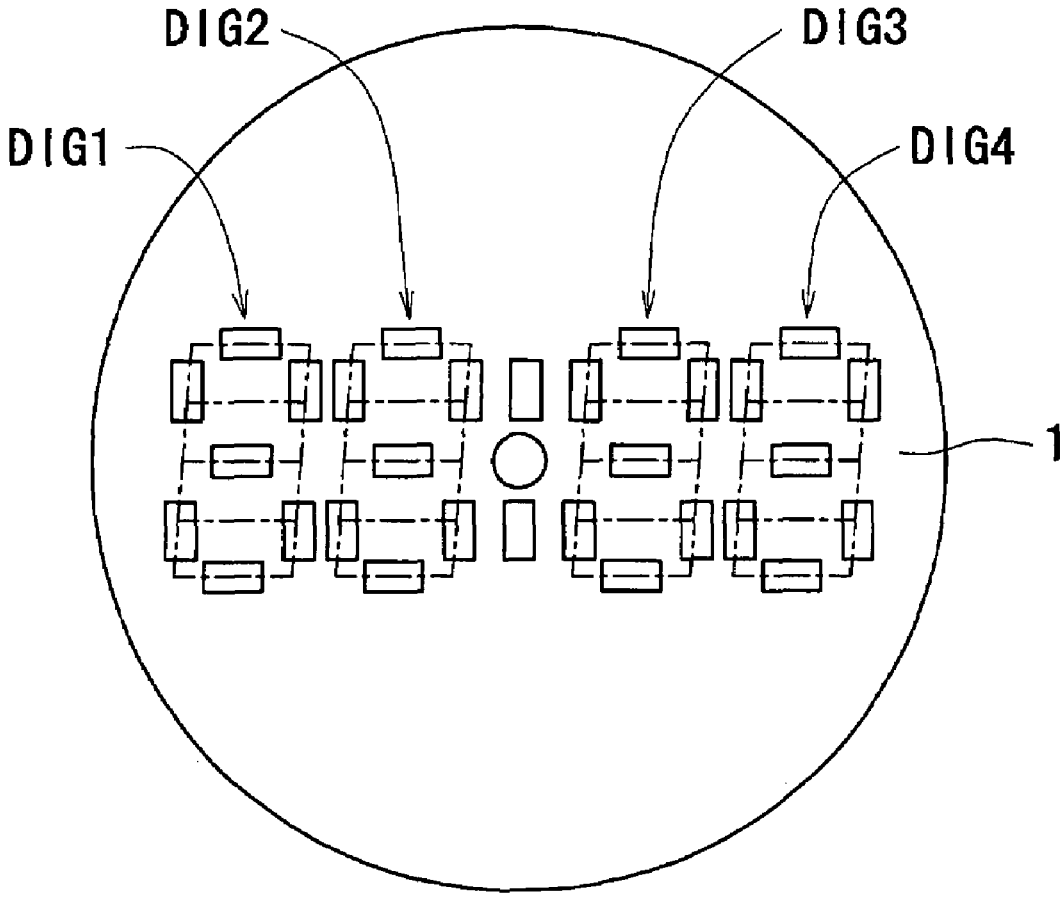
FIG. 24 It is a plan view of a conventional circuit board.
Figure 25:
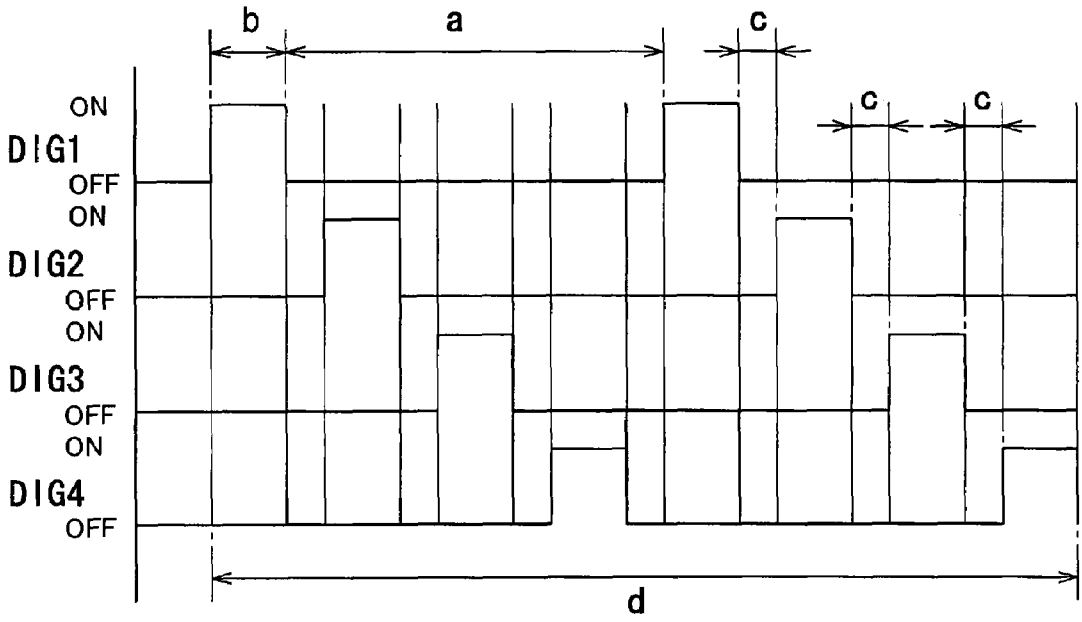
FIG. 25 It is a drive timing chart of numeral displays in a conventional display part.
Figure 26:
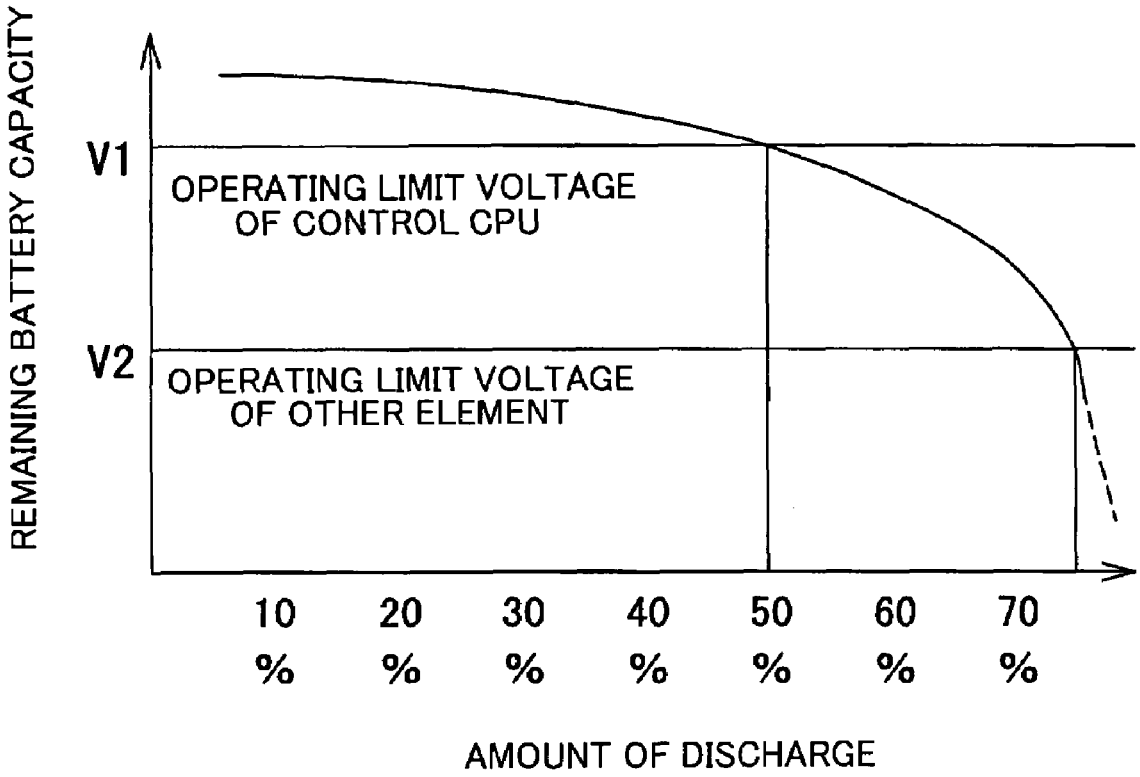
FIG. 26 It is a graph showing a battery discharge curve of a conventional watch.

By making an arrangement like this, in the LED drive circuit 33 including: a secondary battery 30; a control CPU 70 to which an electric power is supplied from the secondary battery 30; and a controlled part 71 that is forced to work by the control CPU 70 as shown in FIG. 21, when the control CPU 70 brings the controlled part 71 into operation, the charger pump 73 raises the voltage in the circuit and feeds its output back to the power source terminal of the control CPU 70. This makes it possible to move up ahead the use of the battery capacity indicated by a hatched portion "s" in FIG. 22, which has been out of use to the end conventionally. Thus, the discharge curve of the secondary battery 30 is changed from "p" to "q" as shown in FIG. 23, whereby the remaining capacity of the secondary battery 30 can be used until reaching a smaller amount, and therefore the battery life can be extended from "f" to "g".

While as for the above-described example, the case of applying the invention to an LED drive circuit 33 of a digital watch has been described, the application is not limited to the LED drive circuit 33. The invention can be applied to a battery-driven electric circuit with a large difference in voltage between the time in operation and the time out of use and a product including the electric circuit. For instance, the invention can be applied to an electric circuit activated based on an input by radio through an antenna, a voice input through a microphone, a timer signal input by a timer or the like other than an input by a switch, and a product including the same, provided that the electric circuit is provided with: a lighting function for turning on another light source; a phonetic function for emitting a voice; a motor-driving function for driving a vibrating motor, etc.; a sensing function for activating a sensor; a wireless transmitting and receiving function for performing transmission and reception by radio, etc.

INDUSTRIAL APPLICABILITY

The invention can be applied to an analog timepiece, and particularly to a watch.

The invention claimed is:

1. An analog watch, comprising:

a dial;

a light-shielding plate superposed and mounted on a rear side of the dial, the light-shielding plate having light-transmitting holes piercing it from a front to a rear thereof;

a circuit board superposed and mounted directly on a rear side of the light-shielding plate;

light-emitting diodes (LEDs) mounted on a front side of the circuit board and inserted in the light-transmitting holes;

an analog movement superposed and mounted on a rear side of the circuit board; and a hand-moving shaft extending from the circuit board through the light-shielding plate to the dial, a leading end of the shaft being exposed on a front side of the dial, wherein the dial is formed so as to have an optical transmittance that allows digital display by the LEDs to be visually identified through the dial only when the LEDs are turned ON, and wherein light from the LEDs travels through the light-transmitting holes and impinges on the dial.

2. The analog watch of claim 1, characterized in that the dial is formed by applying a coat to a transparent material.

3. The analog watch of claim 1, characterized in that the dial is formed with a colored semitransparent material.

4. The analog watch of claim 1, characterized in that the light-shielding plate is formed by using a plate-like resin member having a high light-shielding ability, and applying a light-diffusing coat to inner faces of the light-transmitting holes of the resin member.

5. The analog watch of claim 1, characterized in that the light-shielding plate is formed by using a plate-like resin member having a high photoreflectance and applying a light-shielding coat to a plate surface of the resin member.

6. The analog watch of claim 1, characterized by comprising:

an LED drive circuit for driving the LEDs, placed on the rear side of the circuit board.

7. The analog watch of claim 1, characterized by further comprising:

a pair of the LEDs provided so as to sandwich a central hole of the circuit board through which the hand-moving shaft pierces; and a colon composed of the paired LEDs; and numeral displays composed of the remaining LEDs are allocated and placed in pairs so as to sandwich the colon between the pairs.

8. The analog watch of claim 6 or 7, characterized in that the LEDs are provided in one-to-one correspondence with the light-transmitting holes.

9. The analog watch of claim 8, characterized in that a light diffusion treatment is performed on the dial at least in locations corresponding to the light-transmitting holes.

10. The analog watch as in claims 1, 2, 3, 4, 5, 6 or 7, characterized in that the LED drive circuit includes an LED drive module capable of turning on all the LEDs based on an external operation.

11. The analog watch as in claims 1, 2, 3, 4, 5, 6 or 7, characterized in that the LED drive circuit includes an LED drive module capable of activating an additional clocking function based on an external operation.

12. The analog watch as in claims 1, 2, 3, 4, 5, 6 or 7, characterized by further comprising a secondary battery used as a power source.

13. The analog watch of claim 12, characterized by further comprising a secondary coil which allows the secondary battery to be charged by electromagnetic induction.

14. The analog watch of claim 1, characterized by further comprising a control circuit for controlling an analog hands-moving pulse timing and a digital display pulse timing synchronously.

15. The analog watch of claim 14, characterized in that the digital display pulse timing is matched to the analog hands-moving pulse timing in analog time correction synchronously with start of analog hands' moving.

16. The analog watch of claim 14, characterized in that the digital display is subjected to 30-second rounding and then returned back to zero in analog time correction.

17. The analog watch of any one of claims 14 to 16, characterized in that the digital display pulse timing is synchronized and matched with the analog hands-moving pulse timing in digital time correction.

18. The analog watch of claim 1, characterized by further comprising a control circuit capable of adjusting a duty ratio, wherein the duty ratio is a ratio of a lighting time during which the LEDs for digital display stay on with respect to a total display time during which digital display is performed.

19. The analog watch of claim 18, characterized in that the control circuit can adjust the duty ratio based on time data.

20. The analog watch of claim 18, characterized by further comprising a photosensor, wherein the control circuit can adjust the duty ratio based on an output signal from the photosensor.

21. The analog watch of any one of claims 18 to 20, characterized in that the control circuit can adjust the duty ratio based on the optical transmittance of the dial.

22. The analog watch of any one of claims 18 to 20, characterized in that the control circuit can adjust the duty ratio based on detected voltage data.

23. The analog watch of any one of claims 18 to 20, characterized in that when the numeral displays for performing digital display are shifted by a light source break time, switched and turned on in turn, the control circuit can change the duty ratio by altering the light source break time.

24. The analog watch of claim 1, characterized by further comprising an electric circuit including:

a battery;

a control CPU that accepts supply of an electric power from the battery; and a controlled part that accepts supply of the electric power from the battery and is made to work by the control CPU, wherein the controlled part is provided with a charger pump, and when the control CPU makes the controlled part work, an output of the charger pump is fed back to a power source terminal of the control CPU.

25. The analog watch of claim 24, characterized by further comprising a means capable of setting flow of electric current, the means preventing a flow from the battery and a flow from the charger pump from being mixed.

26. The analog watch of claim 24 or 25, characterized in that the controlled part is provided with an LED for digital display.

* * * * *